US011400465B2

(12) United States Patent
Kikuchi et al.

(10) Patent No.: US 11,400,465 B2
(45) Date of Patent: Aug. 2, 2022

(54) ELECTRODE DEVICE, DISCHARGE APPARATUS, AND ELECTROSTATIC ATOMIZATION SYSTEM

(71) Applicant: Panasonic Intellectual Property Management Co., Ltd., Osaka (JP)

(72) Inventors: Hayato Kikuchi, Shiga (JP); Yasunori Matsui, Shiga (JP); Hiroyuki Inoue, Shiga (JP); Yohei Ishigami, Osaka (JP); Masato Kinoshita, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 79 days.

(21) Appl. No.: 16/796,566

(22) Filed: Feb. 20, 2020

(65) Prior Publication Data

US 2020/0269263 A1 Aug. 27, 2020

(30) Foreign Application Priority Data

Feb. 26, 2019 (JP) ..... JP2019-033312

(51) Int. Cl.

| | |
|---|---|
| ***B05B 5/025*** | (2006.01) |
| ***B05B 5/053*** | (2006.01) |
| ***B05B 5/057*** | (2006.01) |
| ***H01T 1/22*** | (2006.01) |
| *H01T 19/04* | (2006.01) |

(52) U.S. Cl.

CPC ..... *B05B 5/0255* (2013.01); *B05B 5/057* (2013.01); *B05B 5/0533* (2013.01); *H01T 19/04* (2013.01)

(58) Field of Classification Search

CPC ... B05B 5/0255; B05B 5/02533; B05B 5/057; H01T 19/04

See application file for complete search history.

(56) References Cited

U.S. PATENT DOCUMENTS

| | | | | |
|---|---|---|---|---|
| 8,448,419 | B2 * | 5/2013 | Demmons | B05B 5/0533 313/231.01 |
| 8,453,952 | B2 * | 6/2013 | Masuda | B05B 5/0533 239/690 |
| 2010/0243765 | A1 * | 9/2010 | Uegaki | B05B 5/057 239/690 |

(Continued)

FOREIGN PATENT DOCUMENTS

JP 2018-22574 A 2/2018

*Primary Examiner* — Joseph A Greenlund

(74) *Attorney, Agent, or Firm* — McDermott Will & Emery LLP

(57) ABSTRACT

An electrode device includes a discharge electrode and a counter electrode, and discharges when a voltage is applied across the discharge electrode and the counter electrode. The discharge electrode is a columnar electrode having a discharge portion on its front end. The counter electrode faces the discharge portion. The counter electrode has a peripheral electrode portion and a projecting electrode portion. The peripheral electrode portion is disposed to surround an axis of the discharge electrode. The projecting electrode portion projects from a part of the peripheral electrode portion toward the axis of the discharge electrode. A distance from the peripheral electrode portion to the discharge portion is shorter than a distance from the projecting electrode portion to the discharge portion.

14 Claims, 12 Drawing Sheets

(56) References Cited

U.S. PATENT DOCUMENTS

| | | | | |
|---|---|---|---|---|
| 2011/0006139 | A1* | 1/2011 | Masuda | B05B 5/0533 239/690 |
| 2011/0024529 | A1* | 2/2011 | Oe | B05B 5/0255 239/704 |
| 2011/0031335 | A1* | 2/2011 | Hirai | B05B 5/057 239/690 |
| 2011/0168798 | A1* | 7/2011 | Mishima | B05B 5/0255 239/3 |
| 2013/0146683 | A1* | 6/2013 | Imai | B05B 5/057 239/690 |
| 2014/0209710 | A1* | 7/2014 | Komura | B05B 5/053 239/690 |
| 2014/0339343 | A1* | 11/2014 | Nishimura | B05B 5/057 239/690 |
| 2014/0367478 | A1* | 12/2014 | Roos | B05B 5/0535 239/707 |
| 2016/0031708 | A1* | 2/2016 | Machi | A61L 9/22 422/186.2 |
| 2016/0096185 | A1* | 4/2016 | Nobuo | B05B 5/0255 438/46 |
| 2016/0116193 | A1* | 4/2016 | Uratani | B05B 5/0255 239/690 |
| 2016/0175859 | A1* | 6/2016 | Yi | G01F 23/22 239/690 |
| 2018/0029053 | A1* | 2/2018 | Aono | B05B 5/16 |
| 2018/0034248 | A1* | 2/2018 | Ishigami | H01T 21/00 |
| 2019/0111405 | A1* | 4/2019 | Katano | A61L 2/202 |
| 2020/0140274 | A1* | 5/2020 | Machi | A61L 9/12 |
| 2020/0269263 | A1* | 8/2020 | Kikuchi | B05B 5/0255 |
| 2020/0353488 | A1* | 11/2020 | Ishigami | F24F 6/12 |

* cited by examiner

ELECTRODE DEVICE, DISCHARGE APPARATUS, AND ELECTROSTATIC ATOMIZATION SYSTEM

BACKGROUND

1. Technical Field

The present disclosure generally relates to an electrode device, a discharge apparatus, and an electrostatic atomization system, and, more specifically, relates to an electrode device having a discharge electrode and a counter electrode, a discharge apparatus having the electrode device, and an electrostatic atomization system having the discharge apparatus.

2. Description of the Related Art

Unexamined Japanese Patent Publication No. 2018-22574 describes a discharge apparatus that has a discharge electrode and a counter electrode and that applies a voltage across the discharge electrode and the counter electrode to cause discharge that is a grown form of corona discharge. Discharge caused by this discharge apparatus is discharge that intermittently creates a discharge path in a state of dielectric breakdown, the discharge path extending from the discharge electrode toward the surrounding area. The discharge apparatus described in Unexamined Japanese Patent Publication No. 2018-22574 causes discharge carrying high energy, in which an amount of generation of effective components is greater than an amount of generation of effective components in corona discharge.

It is stated in Unexamined Japanese Patent Publication No. 2018-22574 that the counter electrode has a needle-like electrode portion facing the discharge electrode. The discharge apparatus thus causes discharge stably between the discharge electrode and the needle-like electrode portion, the discharge creating the discharge path intermittently.

SUMMARY

However, according to the discharge apparatus described in Unexamined Japanese Patent Publication No. 2018-22574, an electric field is concentrated on a front end of the needle-like electrode portion when discharge is caused. This results in development of glow discharge or arc discharge which involves continuous dielectric breakdown, leading to a possibility that efficiency in generation of effective components may drop.

The present disclosure provides an electrode device, a discharge apparatus, and an electrostatic atomization system that hardly allow efficiency in generation of effective components to drop.

An electrode device according to one aspect of the present disclosure includes a discharge electrode and a counter electrode. The electrode device discharges when a voltage is applied across the discharge electrode and the counter electrode. The discharge electrode is of a columnar shape and has a discharge portion on a front end of the discharge electrode. The counter electrode faces the discharge portion. The counter electrode has a peripheral electrode portion and a projecting electrode portion. The peripheral electrode portion is disposed to surround an axis of the discharge electrode. The projecting electrode portion projects from a part of the peripheral electrode portion toward the axis of the discharge electrode. A distance from the peripheral electrode portion to the discharge portion is shorter than a distance from the projecting electrode portion to the discharge portion.

An electrode device according to another aspect of the present disclosure includes a discharge electrode and a counter electrode. The electrode device discharges when a voltage is applied across the discharge electrode and the counter electrode. The discharge electrode is of a columnar shape and has a discharge portion on a front end of the discharge electrode. The counter electrode faces the discharge portion. The counter electrode has a peripheral electrode portion and a projecting electrode portion. The peripheral electrode portion is disposed in such a way as to surround an axis of the discharge electrode. The projecting electrode portion projects from a part of the peripheral electrode portion toward the axis of the discharge electrode. When a virtual reference line is defined on a virtual plane, the discharge portion lies on a side on which a first edge lies, in a view from the virtual reference line. The virtual plane is a plane including the axis of the discharge electrode and a front end of the projecting electrode portion. The virtual reference line is a perpendicular bisector of a virtual line. The virtual line is a line that connects the first edge to a second edge. The first edge is a part of peripheral electrode portion that has a shortest distance to the discharge portion. The second edge is a part of projecting electrode portion that has a shortest distance to the discharge portion.

A discharge apparatus according to still another aspect of the present disclosure includes an electrode device and a voltage applying circuit. The voltage applying circuit applies a voltage across a discharge electrode and a counter electrode to cause the electrode device to discharge.

An electrostatic atomization system according to still another aspect of the present disclosure includes a discharge apparatus and a liquid supply unit. The electrostatic atomization system electrostatically atomizes a liquid by discharge caused by the discharge apparatus. The liquid supply unit supplies the liquid to a discharge electrode.

The present disclosure offers an advantage that a drop in efficiency in generation of effective components hardly occurs.

DETAILED DESCRIPTION

First Exemplary Embodiment

(1) Outline

Outline of electrode device 3, discharge apparatus 10, and electrostatic atomization system 100 according to a first exemplary embodiment will now be described with reference to FIGS. 1A, 1B, and 2.

Figure 1A:
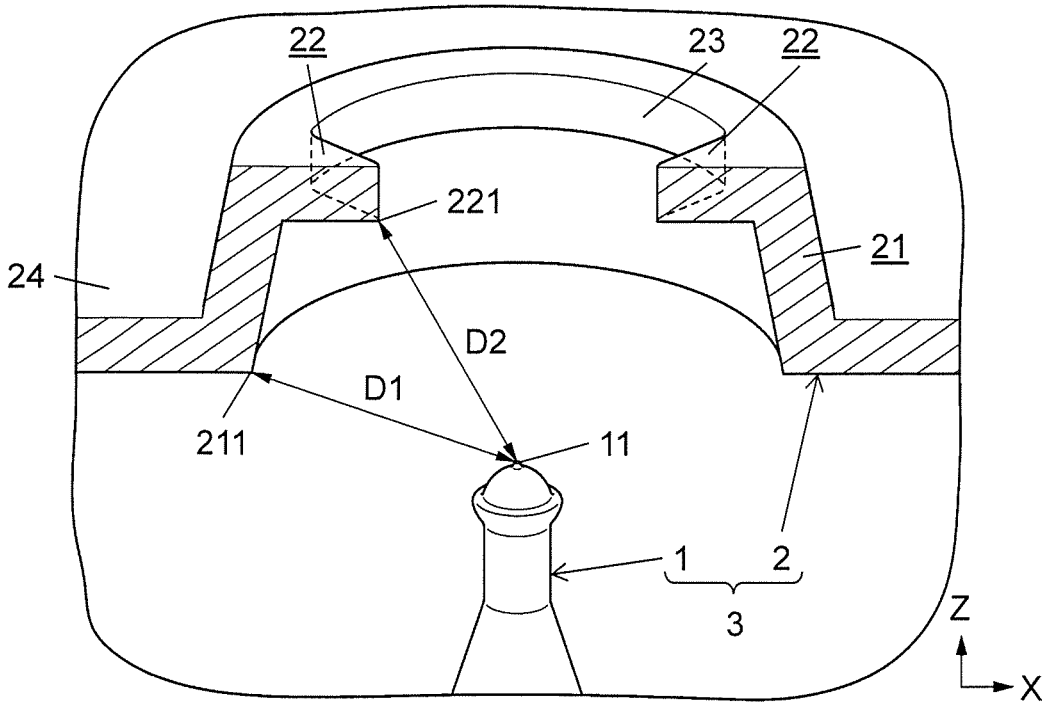
FIG. 1A is a partially broken perspective view diagrammatically showing a principle part of an electrode device of a discharge apparatus according to a first exemplary embodiment.
Figure 1B:
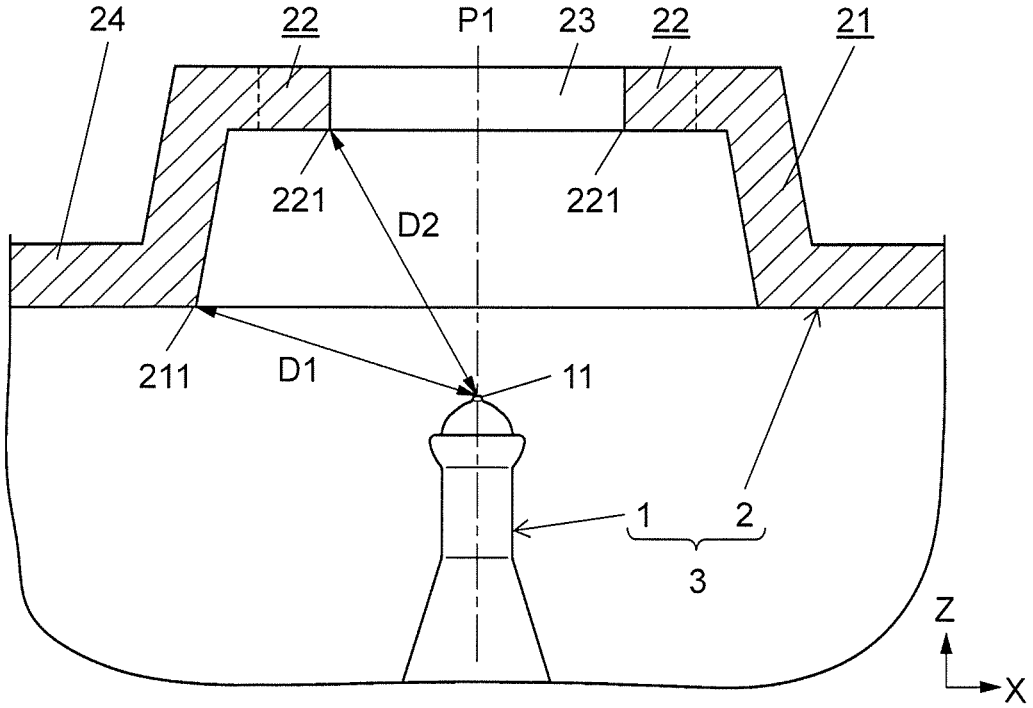
FIG. 1B is a sectional view diagrammatically showing the principle part of the electrode device of the discharge apparatus according to the first exemplary embodiment.

As shown in FIGS. 1A and 1B, electrode device 3 according to the first exemplary embodiment has discharge electrode 1 and counter electrode 2. Electrode device 3 is configured such that it discharges when a voltage is applied across discharge electrode 1 and counter electrode 2.

Figure 2:
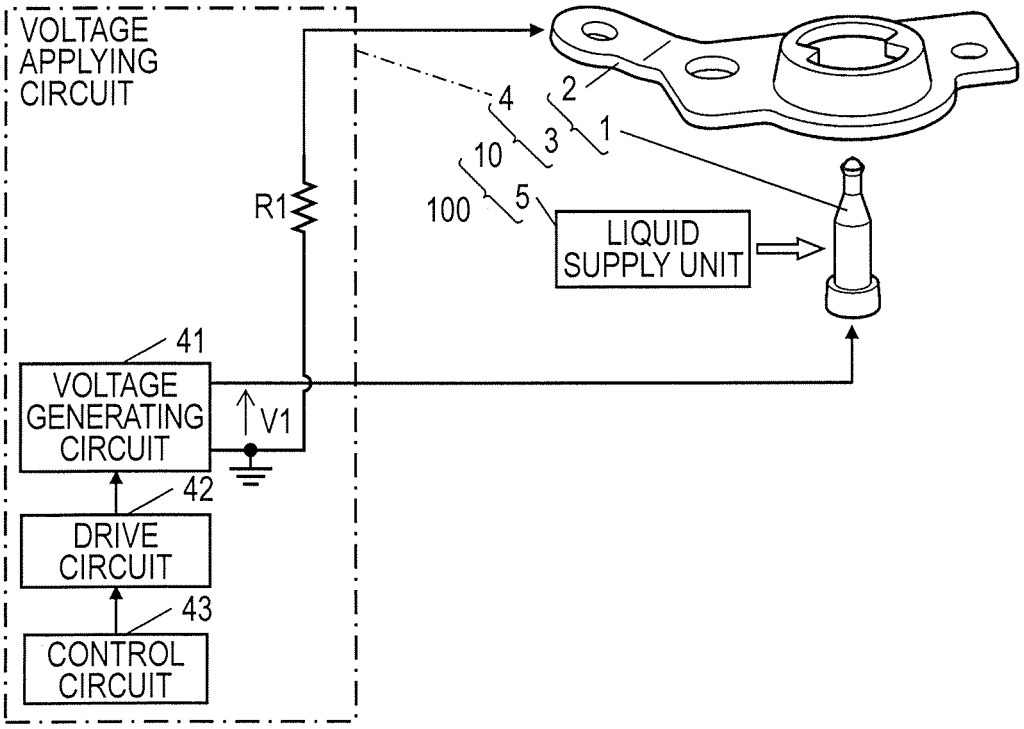
FIG. 2 is a block diagram of an electrostatic atomization system including the discharge apparatus according to the first exemplary embodiment.

As shown in FIG. 2, electrode device 3, together with voltage applying circuit 4, makes up discharge apparatus 10. In other words, discharge apparatus 10 according to this exemplary embodiment includes electrode device 3 and voltage applying circuit 4. Voltage applying circuit 4 applies voltage V1 across discharge electrode 1 and counter electrode 2 to cause discharge.

As shown in FIG. 2, discharge apparatus 10, together with liquid supply unit 5, makes up electrostatic atomization system 100. In other words, electrostatic atomization system 100 according to this exemplary embodiment includes discharge apparatus 10 and liquid supply unit 5. Liquid supply unit 5 supplies liquid 50 to discharge electrode 1 (see FIG. 6A). In this electrostatic atomization system 100, liquid 50 is electrostatically atomized by discharge generated by discharge apparatus 10. Liquid 50 supplied from liquid supply unit 5 adheres to a surface of discharge electrode 1. For example, in a state in which liquid 50 is held by discharge electrode 1, discharge apparatus 10 causes voltage applying circuit 4 to apply the voltage across discharge electrode 1 and counter electrode 2. This causes discharge between discharge electrode 1 and counter electrode 2. Liquid 50 held by discharge electrode 1 is then electrostatically atomized by discharge. In the present disclosure, liquid 50 held by discharge electrode 1 is electrostatically atomized into a mist of liquid 50. It may be nevertheless simply referred to as "liquid 50".

According to this exemplary embodiment, voltage applying circuit 4 cyclically changes a magnitude of applied voltage V1, thereby causing discharge intermittently. Cyclic change in applied voltage V1 causes mechanical vibrations at liquid 50. "Applied voltage" stated in the present disclosure means the voltage that voltage applying circuit 4 applies across discharge electrode 1 and counter electrode 2 to cause discharge.

Figure 6A:
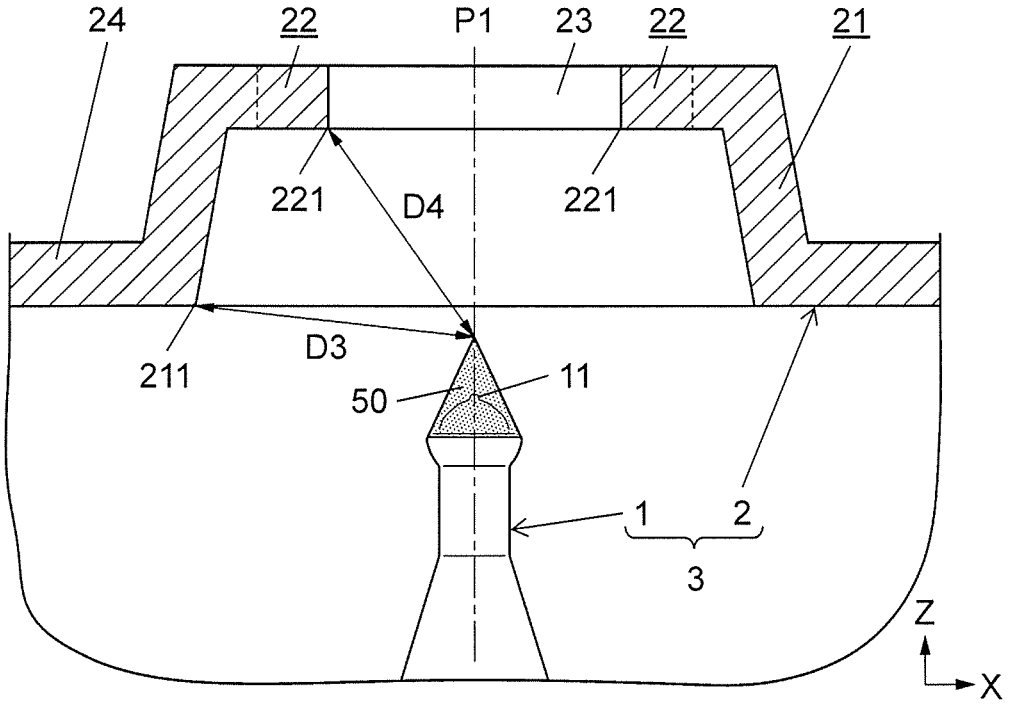
FIG. 6A is a sectional view diagrammatically showing the principle part of the electrode device of the discharge apparatus according to the first exemplary embodiment, showing a liquid in an expanded state in the principle part.

When the voltage (applied voltage V1) is applied across discharge electrode 1 and counter electrode 2, liquid 50 held by discharge electrode 1 is subjected to a force exerted by an electric field, thus forming a conical shape called Taylor cone (see FIG. 6A). This process will be described in detail later. Subsequently, the electric field concentrates on a front end (apex) of the Taylor cone, which leads to development of discharge. At this time, the sharper the front end of the Taylor cone is, that is, the smaller an apex angle of the cone is, which means the acuter the apex angle is, the smaller field intensity needed for dielectric breakdown is, in which case discharge readily occurs. Under an influence of mechanical vibrations, liquid 50 held by discharge electrode 1 expands and contracts along axis P1 (see FIG. 1B) of discharge electrode 1. As a result, liquid 50 alternately deforms into a first shape and a second shape. The first shape refers to liquid 50 in a state of being expanded along axis P1 of discharge electrode 1, that is, liquid 50 in the Tailor cone shape (see FIG. 6A). The second shape refers to liquid 50 in a state of contraction, that is, liquid 50 in a shape formed by collapsing the front end of the Tailor cone shape (see FIG. 6B). Thus, the above Taylor cone is cyclically formed, and discharge occurs intermittently every time the Taylor cone is formed.

As described above, electrode device 3 according to this exemplary embodiment has discharge electrode 1 and counter electrode 2. As shown in FIGS. 1A and 1B, discharge electrode 1 is a columnar electrode having discharge portion 11 on its front end. The counter electrode 2 faces discharge portion 11. Electrode device 3 discharges when a voltage is applied across discharge electrode 1 and counter electrode 2.

Counter electrode 2 has peripheral electrode portion 21 and projecting electrode portions 22. Peripheral electrode portion 21 is disposed to surround axis P1 of discharge electrode 1 (see FIG. 5A). Projecting electrode portions 22 each project from a part of peripheral electrode portion 21 toward axis P1 of discharge electrode 1 (see FIG. 5A). Distance D1 from peripheral electrode portion 21 to discharge portion 11 is shorter than distance D2 from projecting electrode portion 22 to discharge portion 11 (D1<D2). Distance D1 is defined as a shortest distance among distances from various parts of peripheral electrode portion 21 to discharge portion 11.

According to the above configuration, at electrode device 3, when the voltage (applied voltage V1) is applied across discharge electrode 1 and counter electrode 2, an electric field could concentrate on both peripheral electrode portion 21 and projecting electrode portion 22 of counter electrode 2 facing discharge portion 11. Because projecting electrode portion 22 projects from the part in the circumferential direction of peripheral electrode portion 21 toward axis P1 of discharge electrode 1, a facing area of peripheral electrode portion 21 that faces discharge portion 11 is larger than a facing area of projecting electrode portion 22 that faces discharge portion 11. For this reason, an extent of electric filed concentration at projecting electrode portion 22, which has the facing area smaller than the facing area of peripheral electrode portion 21, the facing areas facing discharge portion 11, is greater than an extent of electric filed concentration at peripheral electrode portion 21. Meanwhile, because distance D1 from peripheral electrode portion 21 to discharge portion 11 is shorter than distance D2 from projecting electrode portion 22 to discharge portion 11, when the voltage is applied across discharge electrode 1 and counter electrode 2, an electric field generated between peripheral electrode portion 21 and discharge portion 11 becomes dominant first. This results in development of discharge in a state in which the extent of electric field concentration is relatively low. In this case, corona discharge is apt to occur. Glow discharge or arc discharge that involves continuous dielectric breakdown, therefore, hardly occurs, which means that a case of a drop in efficiency in generation of effective components (acidic components, air ions, radicals, and a charged particle liquid containing such components) due to glow discharge or arc discharge hardly occurs.

When liquid 50 held by discharge electrode 1 is subjected to a force exerted by an electric field and forms the Tailor cone, for example, the electric field tends to concentrate in an area between the front end (apex) of the Tailor cone and projecting electrode portion 22. As a result, discharge carrying relatively high energy develops between liquid 50 and projecting electrode portion 22. This causes corona discharge having occurred at liquid 50 held by discharge electrode 1 to grow into discharge carrying higher energy. As a result, between discharge electrode 1 and counter electrode 2, discharge path L1 (see FIG. 8C) at least partially in a state of dielectric breakdown can be formed intermittently.

(2) Detailed Description

Details of electrode device 3, discharge apparatus 10, and electrostatic atomization system 100 according to this exemplary embodiment will hereinafter be described with reference to FIGS. 1A to 8C.

In the following description, three axes, i.e., an X-axis, a Y-axis, and a Z-axis perpendicular to each other are defined. An axis extending along axis P1 of discharge electrode 1 is defined as the Z-axis, and an axis extending along a direction in which projecting electrode portion 22 projects is defined as the X-axis. The Y-axis is perpendicular to the X-axis and to the Z-axis as well. A side on which counter electrode 2 lies, which is seen from discharge electrode 1, is defined as a positive side of the Z-axis. Each of the X-axis, Y-axis, and Z-axis is a virtual axis. Arrows denoted as "X", "Y", and "Z" in drawings express the X-axis, Y-axis, and Z-axis, respectively, for better description and do not represent axes as real entity. X, Y, and Z directions represented by these axes do not indicate that when electrode device 3 is used, its direction of setting is limited to a certain direction.

(2.1) Overall Configuration

As described above, electrostatic atomization system 100 according to this exemplary embodiment includes discharge apparatus 10 and liquid supply unit 5, as shown in FIG. 2. Discharge apparatus 10 according to this exemplary embodiment includes electrode device 3 and voltage applying circuit 4.

Electrode device 3 includes discharge electrode 1 and counter electrode 2. FIG. 2 diagrammatically depicts shapes of discharge electrode 1 and counter electrode 2. As described above, electrode device 3 discharges when a voltage is applied across discharge electrode 1 and counter electrode 2.

As shown in FIGS. 1A and 1B, discharge electrode 1 is the columnar electrode extending along the Z-axis. Discharge electrode 1 has discharge portion 11 on one end (front end) in a longitudinal direction (Z-axis direction) thereof, and base end 12 (see FIG. 4) on the other end (end opposite to the front end) in the longitudinal direction. Discharge electrode 1 at least has its discharge portion 11 formed into a tapered shape, thus being provided as a needle electrode. "Tapered shape" mentioned here is not limited to a shape having a sharply pointed front end, but includes such a shape having a roundish front end as shown in FIGS. 1A and 1B.

Counter electrode 2 is disposed in such a way as to face discharge portion 11 of discharge electrode 1. As described above, counter electrode 2 has peripheral electrode portion 21 and projecting electrode portion 22. Peripheral electrode portion 21 is disposed to surround axis P1 of discharge electrode 1. Projecting electrode portion 22 projects from the part in the circumferential direction of peripheral electrode portion 21 toward axis P1 of discharge electrode 1.

Figure 3:
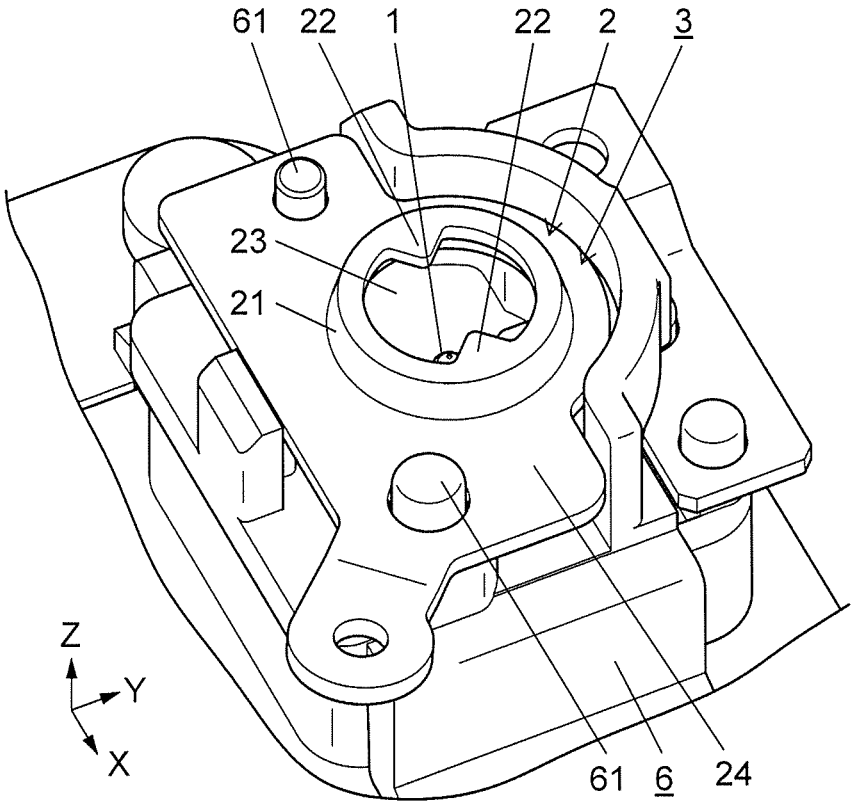
FIG. 3 is a schematic perspective view of a principle part of the discharge apparatus according to the first exemplary embodiment.
Figure 4:
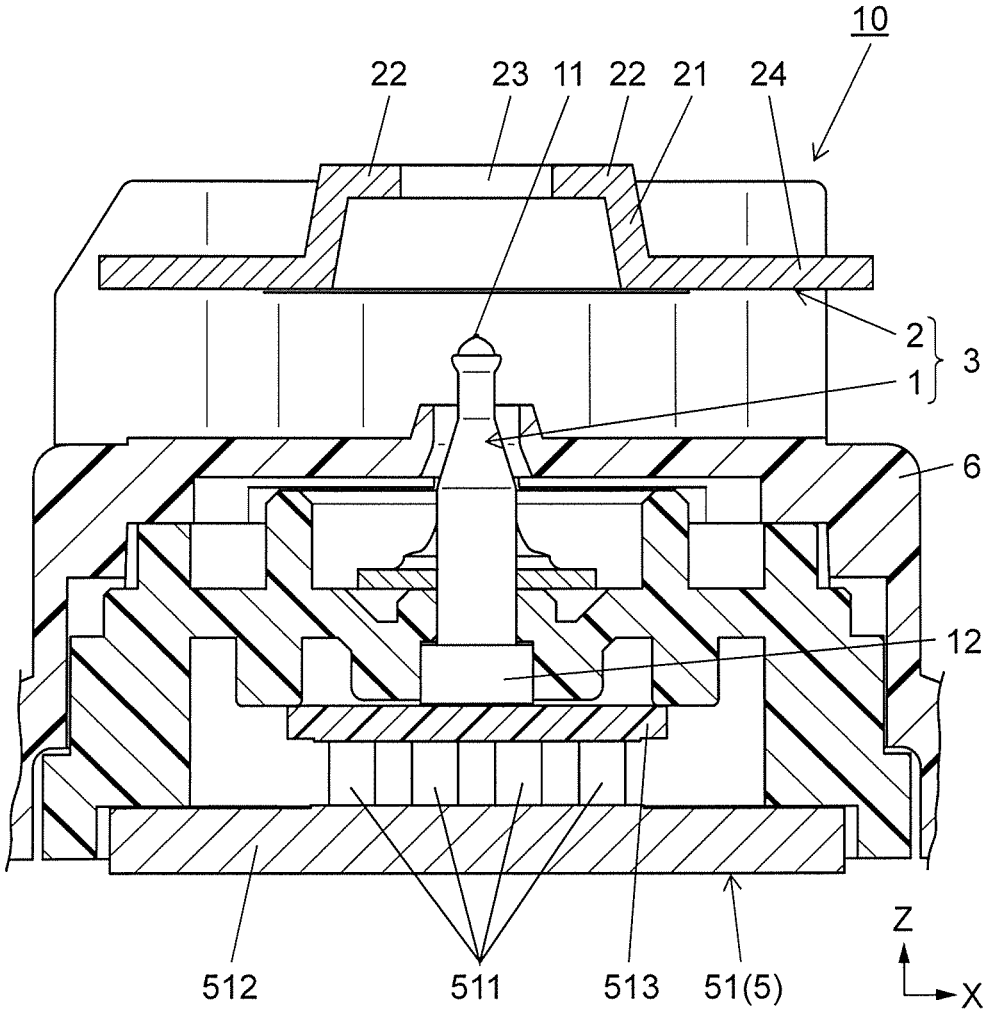
FIG. 4 is a schematic sectional view of the principle part of the discharge apparatus according to the first exemplary embodiment.

According to this exemplary embodiment, as shown in FIGS. 3 and 4, counter electrode 2 has tabular portion 24 of a plate shape elongated in the X-axis direction. As shown in FIG. 4, in the direction (Z-axis direction) along axis P1 of discharge electrode 1, discharge electrode 1 is separated from counter electrode 2. In other words, as shown in FIG. 4, discharge electrode 1 and counter electrode 2 are in a positional relationship that they are separated from each other in the direction (Z-axis direction) along axis P1 of discharge electrode 1.

On a part of tabular portion 24, opening 23 is formed in such a way as to penetrate tabular portion 24 in a direction of its thickness (Z-axis direction). On counter electrode 2, a part along a periphery of this opening 23 serves as peripheral electrode portion 21. A part projecting from peripheral electrode portion 21 into opening 23 serves as projecting electrode portion 22.

Discharge electrode 1 and counter electrode 2 are held in housing 6 made of synthetic resin, the housing 6 having electrical insulation property. Tabular portion 24, for example, is coupled to housing 6 by thermal caulking, etc., performed at a pair of caulking projections 61 (see FIG. 3) formed on housing 6. As a result, counter electrode 2 is held in housing 6.

The positional relationship between counter electrode 2 and discharge electrode 1 is determined such that the direction of thickness of counter electrode 2 (direction in which opening 23 penetrates tabular portion 24) matches the longitudinal direction of discharge electrode 1 (Z-axis direction) and that discharge portion 11 of discharge electrode 1 is located near a center of opening 23 of counter electrode 2. Specifically, the center of opening 23 lies on axis P1 of discharge electrode 1, and at least a gap (space) is provided between counter electrode 2 and discharge electrode 1 because of the presence of opening 23 of counter electrode 2. In other words, counter electrode 2 is disposed so as to face discharge electrode 1 across the gap and is electrically insulated from discharge electrode 1.

The detailed shapes of discharge electrode 1 and counter electrode 2 of electrode device 3 will be described in "(2.3) Electrode device".

Liquid supply unit 5 supplies liquid 50 for electrostatic atomization to discharge electrode 1. Liquid supply unit 5 is provided, for example, as cooler 51 that cools discharge electrode 1 to cause it to generate dew condensation water. Specifically, cooler 51 has, for example, a plurality of (four) Peltier elements 511 and a radiation shield 512, as shown in FIG. 4. Peltier elements 511 are, for example, mechanically and electrically connected to radiation shield 512 by soldering and are therefore held on radiation shield 512. Each Peltier element 511 has one end (end closer to radiation shield 512) serving as a heat-releasing end, and another end (end opposite to radiation shield 512) serving as a heat-absorbing end.

Peltier elements 511 are mechanically connected to discharge electrode 1 via insulating board 513. In other words, discharge electrode 1 has its base end 12 mechanically connected to insulating board 513, and Peltier elements 511 have their heat-absorbing ends mechanically connected to insulating board 513. This means that discharge electrode 1 and Peltier elements 511 are thermally coupled together as they are electrically insulated from each other via insulating board 513.

At this cooler 51, supplying current to Peltier elements 511 cools discharge electrode 1 thermally coupled to Peltier elements 511. In this cooling process, cooler 51 cools the whole of discharge electrode 1 via base end 12. As a result, moisture in the air condenses and adheres to a surface of discharge electrode 1 as dew condensation water. In this manner, liquid supply unit 5 is configured to cool discharge electrode 1 and generate dew condensation water, i.e., liquid 50 on the surface of discharge electrode 1. In this configuration, liquid supply unit 5 can supply liquid 50 (dew condensation water) to discharge electrode 1 by using moisture in the air, and therefore supplying and replenishing electrostatic atomization system 100 with a liquid is unnecessary.

Voltage applying circuit 4, together with electrode device 3, makes up discharge apparatus 10. As described above, voltage applying circuit 4 is the circuit that applies voltage V1 across discharge electrode 1 and counter electrode 2 to cause discharge.

As shown in FIG. 2, voltage applying circuit 4 has voltage generating circuit 41, drive circuit 42, and control circuit 43. Voltage applying circuit 4 further has limiting resistor R1. Voltage generating circuit 41 is a circuit that is supplied with power from a power supply to generate the voltage (applied voltage V1) to be applied to electrode device 3. "Power supply" mentioned here is a power supply that supplies operating power to voltage generating circuit 41 or the like. This power supply, for example, is a power supply circuit that generates DC voltage of about several volts to several tens of volts. Drive circuit 42 is a circuit that drives voltage generating circuit 41. Control circuit 43 controls drive circuit 42 based on, for example, a monitoring subject. "Monitoring subject" mentioned here refers to at least either an output current or an output voltage from voltage applying circuit 4.

Voltage generating circuit 41 is provided as, for example, an insulated DC/DC converter. Voltage generating circuit 41 raises an input voltage from the power supply and outputs the raised voltage as applied voltage V1. The output voltage from voltage generating circuit 41 is applied to electrode device 3 (discharge electrode 1 and counter electrode 2), which serves as applied voltage V1.

Voltage generating circuit 41 is electrically connected to electrode device 3 (discharge electrode 1 and counter electrode 2). Voltage generating circuit 41 applies a high voltage to electrode device 3. Voltage generating circuit 41 is configured such that it apples a high voltage across discharge electrode 1, which serves as a positive electrode (positive node), and counter electrode 2, which serves as a negative electrode (ground). In other words, in a state where the high voltage is applied from voltage applying circuit 4 to electrode device 3, a potential difference is created between discharge electrode 1 and counter electrode 2 such that discharge electrode 1 has a high potential and counter electrode 2 has a low potential. "High voltage" mentioned here is a set voltage that causes full-scale dielectric breakdown discharge or partial dielectric breakdown discharge, which will be described later, at electrode device 3, and is specified as, for example, a voltage with a peak of about 6.0 kV. Full-scale dielectric breakdown discharge and partial dielectric breakdown discharge will be described in detail in "(2.4) Forms of discharge". It should be noted, however, that the high voltage applied from voltage applying circuit 4 to electrode device 3 is not limited to a voltage of about 6.0 kV. This high voltage is set properly according to, for example, the shapes of discharge electrode 1 and counter electrode 2 or a distance between discharge electrode 1 and counter electrode 2.

Limiting resistor R1 is disposed between voltage generating circuit 41 and electrode device 3. In other words, voltage applying circuit 4 has voltage generating circuit 41 that generates applied voltage V1, and limiting resistor R1 disposed between one output end of voltage generating circuit 41 and electrode device 3. Limiting resistor R1 is a resistor that limits a peak value of a discharge current that flows after occurrence of dielectric breakdown. This means that limiting resistor R1 has a function of limiting a current that follows through electrode device 3 at the occurrence of discharge, thereby protecting electrode device 3 and voltage applying circuit 4 from overcurrent.

According to this exemplary embodiment, limiting resistor R1 is disposed between voltage generating circuit 41 and counter electrode 2. As described above, counter electrode 2 serves as the negative electrode (ground). Limiting resistor R1 is, therefore, interposed between a low-potential-side output end of voltage generating circuit 41 and electrode device 3.

Operation modes in which voltage applying circuit 4 operates include two operation modes: a first mode and a second mode. The first mode is a mode in which applied voltage V1 is raised as time goes by to cause corona discharge to grow and form discharge path L1 (see FIG. 8C) between discharge electrode 1 and counter electrode 2, discharge path L1 being at least partially in a state of dielectric breakdown, thus generating a discharge current.

The second mode is a mode in which electrode device 3 is put into an overcurrent state and the discharge current is cut off by control circuit 43 and the like. "Discharge current" stated in the present disclosure refers to a relatively large current that flows through discharge path L1, and does not include a microcurrent of about several microamperes that is created by corona discharge before the formation of discharge path L1. "Overcurrent state" stated in the present disclosure refers to a state in which a load size reduces due to discharge and, consequently, a current equal to or larger than a specified current value flows through electrode device 3.

According to this exemplary embodiment, control circuit 43 controls drive circuit 42, thereby controlling voltage applying circuit 4. Control circuit 43 controls drive circuit 42 such that in a drive period during which voltage applying circuit 4 is driven, voltage applying circuit 4 repeatedly operates in the first mode and the second mode alternately. Control circuit 43 switches the first mode and the second mode to each other at a drive frequency so that a magnitude of applied voltage V1, which is applied from voltage applying circuit 4 to electrode device 3, is cyclically changed at the drive frequency. "Drive period" stated in the present disclosure refers to a period in which voltage applying circuit 4 is driven to cause electrode device 3 to discharge.

Specifically, voltage applying circuit 4 does not keep the voltage applied to electrode device 3, which includes discharge electrode 1, at a fixed voltage value, but cyclically changes the voltage in magnitude at the drive frequency within a given range. By cyclically changing the magnitude of applied voltage V1, voltage applying circuit 4 causes discharge intermittently. This means that in synchronization with a cycle of change in applied voltage V1, discharge path L1 is formed cyclically, and therefore discharge occurs cyclically. In the following description, a cycle at which discharge (full-scale dielectric breakdown discharge or partial dielectric breakdown discharge) occurs is referred to as "discharge cycle". Thus, a magnitude of electric energy that acts on liquid 50 held by discharge electrode 1 changes cyclically at the drive frequency, and, consequently, liquid 50 held by discharge electrode 1 mechanically vibrates at the drive frequency.

Now, to increase an amount of deformation of liquid 50, it is preferable that the drive frequency, which is the frequency at which applied voltage V1 changes, be determined to be a frequency value within a given range including a resonance frequency (natural frequency) of liquid 50 held by discharge electrode 1, that is, a frequency value close to the resonance frequency of liquid 50. "Given range" stated in the present disclosure is a range of a frequency that amplifies mechanical vibration of liquid 50 when a force (energy) applied to liquid 50 is vibrated at the frequency. This "given range" specifies a lower limit frequency value and an upper limit frequency value with respect to the resonance frequency of liquid 50 defined as a reference value. In short, the drive frequency is determined to be a frequency value close to the resonance frequency of liquid 50. In this case, an amplitude of mechanical vibration of liquid 50 that is caused by changes in the magnitude of applied voltage V1 is relatively large. The amount of deformation of liquid 50 that is caused by the mechanical vibration of liquid 50 is, therefore, turned out to be large. The resonance frequency of liquid 50 varies depending on, for example, a volume (amount), surface tension, viscosity, or the like of liquid 50.

In electrostatic atomization system 100 according to this exemplary embodiment, liquid 50 mechanically vibrates at the drive frequency close to the resonance frequency of liquid 50, thus vibrating at a relatively large amplitude. As a result, liquid 50 forms the Tailor cone with the front end (apex) of a more sharply pointed (acute angle) shape when exposed to an electric field acting on liquid 50. In this case, compared with a case where liquid 50 mechanically vibrates at a frequency distant from the resonance frequency of liquid 50, a field intensity required for dielectric breakdown in a state in which the Taylor cone has been formed is small, which allows discharge to readily occur. Therefore, for example, even if there are variations in the magnitude of the voltage (applied voltage V1) applied from voltage applying circuit 4 to electrode device 3, in the shape of discharge electrode 1, or in the amount (volume) of liquid 50 supplied to discharge electrode 1, discharge can be caused in a stable manner. Voltage applying circuit 4 can keep the magnitude of the voltage, which is applied to electrode device 3 including discharge electrode 1, relatively small. For this reason, a structure provided around electrode device 3 as an insulating measure can be simplified, and a withstand voltage of a component incorporated in voltage applying circuit 4 or the like can be reduced.

(2.2) Operation

In electrostatic atomization system 100 having the above configuration, voltage applying circuit 4 operates in the following manner to cause electrode device 3 (discharge electrode 1 and counter electrode 2) to discharge.

During a period before formation of discharge path L1, control circuit 43 monitors an output voltage from voltage applying circuit 4, as a monitoring subject. When a maximum value of the output voltage, i.e., monitoring subject becomes equal to or larger than a threshold, control circuit 43 causes voltage applying circuit 4 to reduce energy output from voltage generating circuit 41. In a period after formation of discharge path L1, in contrast, control circuit 43 monitors an output current from voltage applying circuit 4, as a monitoring subject. When the output current, i.e., monitoring subject becomes equal to or larger than a threshold, control circuit 43 causes voltage applying circuit 4 to reduce energy output from voltage generating circuit 41. As a result, voltage applying circuit 4 operates in the second mode in which the voltage applied to electrode device 3 is reduced to put electrode device 3 in an overcurrent state and a discharge current is cut off. In other words, voltage applying circuit 4 shifts in operation mode from the first mode to the second mode.

At this time, both output voltage and output current from voltage applying circuit 4 drop. In response to this, control circuit 43 causes drive circuit 42 to resume its operation. Through these processes, the voltage applied to electrode device 3 rises as time goes by, which causes corona discharge to grow, thus forming discharge path L1 between discharge electrode 1 and counter electrode 2, discharge path L1 being at least partially in a state of dielectric breakdown.

During the drive period, control circuit 43 repeats the operations described above, which causes voltage applying circuit 4 to repeatedly operate in the first mode and the second mode alternately. As a result, a magnitude of electric energy acting on liquid 50 held by discharge electrode 1 changes cyclically at the drive frequency. This causes liquid 50 to vibrate mechanically at the drive frequency.

In short, as a result of applying the voltage from voltage applying circuit 4 to electrode device 3 including discharge electrode 1, a force exerted by an electric field acts on liquid 50 held by discharge electrode 1, thus causing liquid 50 to deform. At this time, force F1 acting on liquid 50 held by discharge electrode 1 is expressed as a product of charge amount q1, which represents an amount of charges included in liquid 50, and electric field E1 (F1=q1×E1). According to this exemplary embodiment, because the voltage is applied across discharge electrode 1 and counter electrode 2, a force that pulls liquid 50 toward counter electrode 2 is applied to liquid 50 by the electric filed. Thus, as shown in FIG. 6A, being subjected to such a force exerted by the electric field, liquid 50 held by discharge portion 11 of discharge electrode 1 is stretched toward counter electrode 2 along axis P1 of discharge electrode 1, axis P1 representing the Z-axis direction, to form the conical shape called Tailor cone. In a state depicted in FIG. 6A, when the voltage applied to electrode device 3 decreases, the force acting on liquid 50 under an influence of the electric field also decreases, which leads to deformation of liquid 50. As a result, liquid 50 held by discharge portion 11 of discharge electrode 1 contracts, as shown in 6B.

Figure 6B:
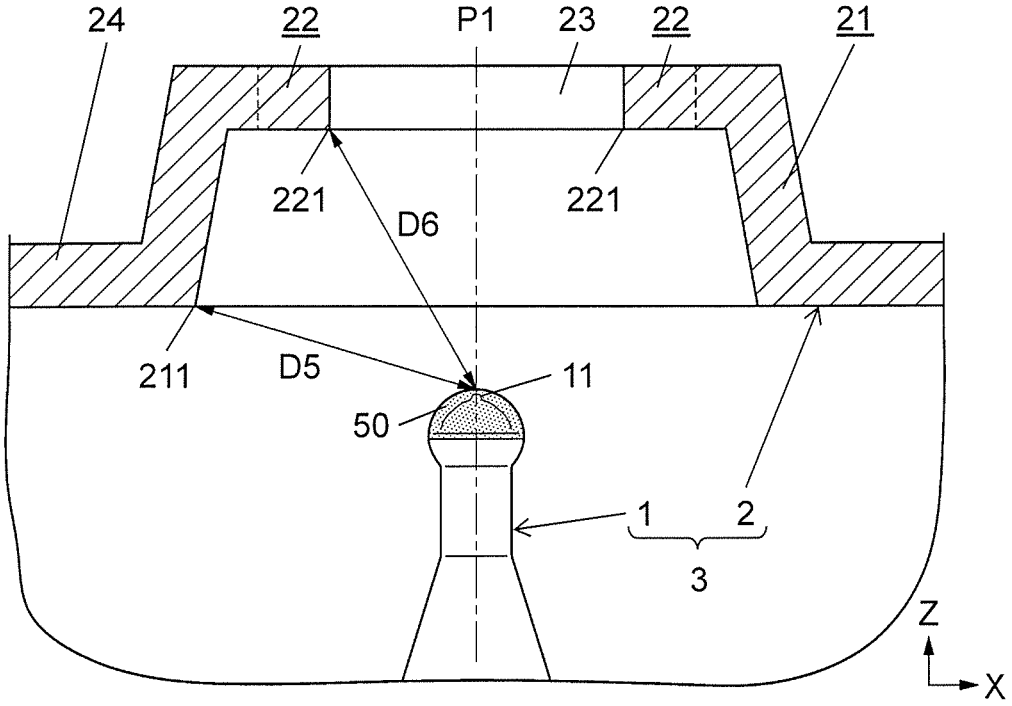
FIG. 6B is a sectional view diagrammatically showing the principle part of the electrode device of the discharge apparatus according to the first exemplary embodiment, showing the liquid in a contracted state in the principle part.

Then, as a result of cyclic changes at the drive frequency in the magnitude of the voltage applied to electrode device 3, liquid 50 held by discharge electrode 1 alternately deforms into a shape shown in FIG. 6A and a shape shown in FIG. 6B. According to this exemplary embodiment, discharge electrode 1 holds liquid 50 in such a way as to cover discharge portion 11 with liquid 50. Liquid 50 expands and contracts along axis P1 of discharge electrode 1, axis P1 representing the Z-axis direction, because of discharge. Since electric filed concentration on the front end (apex) of the Tailor cone causes discharge, dielectric breakdown occurs in a state in which the front end of the Tailor cone is pointed, as shown in FIG. 6A. In synchronization with the drive frequency, therefore, discharge (full-scale dielectric breakdown discharge or partial dielectric breakdown discharge) occurs intermittently.

Liquid 50 held by discharge electrode 1 is thus electrostatically atomized by discharge. As a result, in electrostatic atomization system 100, a nanometer-sized charged particle liquid containing radicals is generated. The generated charged particle liquid is discharged around discharge apparatus 10 through, for example, opening 23 of counter electrode 2.

(2.3) Electrode Device

Figure 5A:
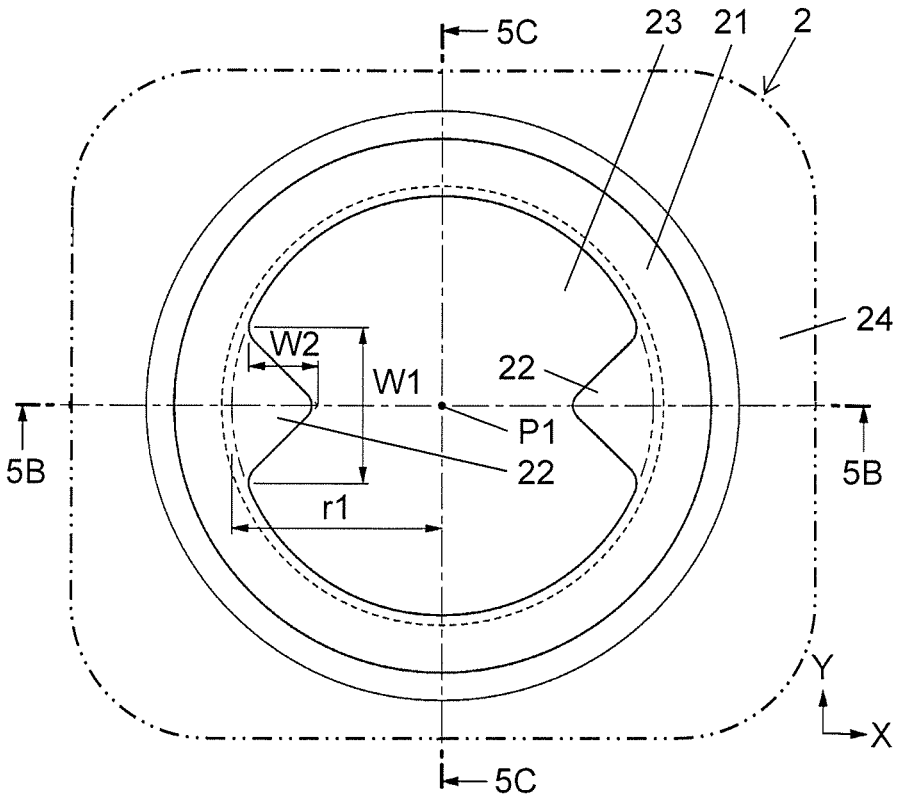
FIG. 5A is a plan view of a principle part of a counter electrode of the electrode device of the discharge apparatus according to the first exemplary embodiment.
Figure 5B:
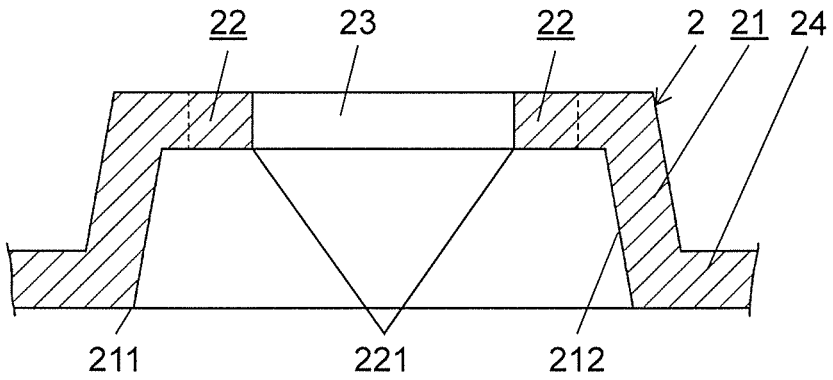
FIG. 5B is a sectional view taken along 5B-5B line of FIG. 5A.
Figure 5C:
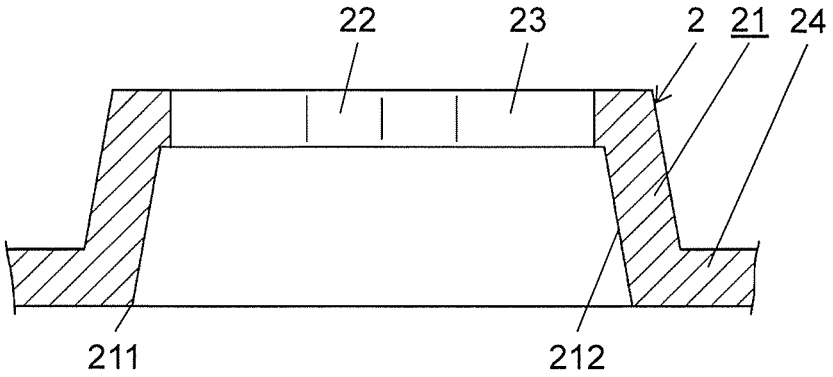
FIG. 5C is a sectional view taken along 5C-5C line of FIG. 5A.

A detailed shape of electrode device 3 (discharge electrode 1 and counter electrode 2) used in discharge apparatus 10 according to this exemplary embodiment will then be described with reference to FIGS. 1A, 1B, and 5A to 7. Principle parts of discharge electrode 1 and counter electrode 2 that make up electrode device 3 are depicted diagrammatically in FIGS. 1A, 1B, and 6A to 7, from which constituent elements other than discharge electrode 1 and counter electrode 2 are omitted when necessary. FIGS. 5A to 5C each depict counter electrode 2 only.

As described above, according to this exemplary embodiment, counter electrode 2 has peripheral electrode portion 21 and projecting electrode portion 22. Peripheral electrode portion 21 is disposed to surround axis P1 of discharge electrode 1 (see FIG. 5A in which peripheral electrode portion 21 is seen from one side of the Z-axis). Projecting electrode portion 22 projects from the part in the circumferential direction of peripheral electrode portion 21 toward axis P1 of discharge electrode 1 (see FIG. 5A).

Discharge electrode 1 is made of, for example, a conductive metal material, such as copper-tungsten alloy (Cu—W alloy). As shown in FIGS. 1A and 1B, discharge electrode 1 is the columnar electrode extending along the Z-axis. Discharge electrode 1 has discharge portion 11 on its one end (front end) in the longitudinal direction (Z-axis direction).

According to this exemplary embodiment, the front end (end closer to discharge portion 11) of discharge electrode 1 is formed substantially into a hemispherical shape as a whole. Discharge portion 11 is on axis P1 of discharge electrode 1 and is also formed substantially into a hemispherical shape. However, a radius of curvature of discharge portion 11 is sufficiently smaller than a radius of curvature of the whole of the front end of discharge electrode 1. When liquid supply unit 5 supplies liquid 5 to discharge electrode 1, liquid 50 is held by discharge electrode 1 such that liquid 50 at least covers discharge portion 11 (see FIGS. 6A and 6B).

Counter electrode 2 is made of, for example, a conductive metal material, such as copper-tungsten alloy (Cu—W alloy). According to this exemplary embodiment, as described above, counter electrode 2 has tabular portion 24 of a plate shape. On a part of tabular portion 24, opening 23 is formed in such a way as to penetrate tabular portion 24 in the direction of its thickness (Z-axis direction), as shown in FIGS. 5A to 5C. On counter electrode 2, the part along the periphery of this opening 23 serves as peripheral electrode portion 21. The part projecting from peripheral electrode portion 21 into opening 23 serves as projecting electrode portion 22.

More specifically, on a part of tabular portion 24, peripheral electrode portion 21 of a domed shape is formed, peripheral electrode portion 21 projecting toward a side separated apart from discharge electrode 1 (positive side of the Z-axis) in a direction along axis P1 of discharge electrode 1 (Z-axis direction). Peripheral electrode portion 21, for example, is formed into a hemispherical shell shape (domed shape) that is flat in the Z-axis direction, by caving in a part of tabular portion 24 by a drawing process. As shown in FIGS. 5B and 5C, peripheral electrode portion 21 has an inner surface 212 caving in to separate from discharge electrode 1. Inner surface 212 is a tapered surface sloping against axis P1 of discharge electrode 1 such that an inner diameter of an edge of the tapered surface that is more distant from discharge electrode 1 in the Z-axis direction is smaller than an inner diameter of an edge of the tapered surface that is closer to discharge electrode 1 in the Z-axis direction.

At a center of peripheral electrode portion 21, opening 23 is formed. Opening 23 is a circular opening that penetrates counter electrode 2 along the direction of its thickness (Z-axis direction). In FIG. 5A, an inner peripheral edge of peripheral electrode portion 21, i.e., the periphery of opening 23, and an outer peripheral edge of peripheral electrode portion 21 are indicated respectively by virtual lines (two-dot chain lines). In other words, in FIG. 5A, an area between two virtual lines (two-dot chain lines), which draw concentric circles, corresponds to peripheral electrode portion 21. The center of opening 23 lies on axis P1 of discharge electrode 1.

Projecting electrode portion 22 projects from the inner peripheral edge of peripheral electrode portion 21, i.e., periphery of opening 23 toward the center of opening 23. According to this exemplary embodiment, a plurality of (two) projecting electrode portions 22 are formed. Each of projecting electrode portions 22 projects from the part in the circumferential direction of peripheral electrode portion 21 toward axis P1 of discharge electrode 1.

(Two) projecting electrode portions 22 are arranged at equal intervals along the circumferential direction of peripheral electrode portion 21. According to this exemplary embodiment, counter electrode 2 has two projecting electrode portions 22, and these two projecting electrode portions 22 are arranged in locations at which they are 180-degree rotation symmetric with each other in the circumferential direction of peripheral electrode portion 21 (circumferential direction of opening 23). Such opening 23 and projecting electrode portions 22 are formed by, for example, a punching process.

Electrode device 3 according to this exemplary embodiment is configured to intermittently form discharge path L1 at least partially in a state of dielectric breakdown between discharge portion 11 of discharge electrode 1 and projecting electrode portion 22 of counter electrode 2 so as to increase an amount of generation of acidic components. In this case, to reduce an amount of generation of ozone, it is preferable to concentrate an electric field on a front end part of each projecting electrode portion 22. For this reason, it is preferable that projecting electrode portion 22 be of a triangular shape in a plan view, as shown in FIG. 5A. "Triangular shape" stated in the present disclosure is not limited to a triangle with three apexes but includes a triangular shape with a front end of a rounded surface (curved surface), such as projecting electrode portion 22 shown in FIG. 5A.

In a plan view, to concentrate an electric field on the front end (apex) of projecting electrode portion 22 of a triangular shape, it is preferable that the front end (apex) of projecting electrode portion 22 have an acute angle in a plan view. However, because projecting electrode portion 22 is formed by, for example, the punching process, an excessively small angle of the front end (apex) of projecting electrode portion 22 in a plan view raises a high possibility that a die may be damaged. Thus, to concentrate an electric field on the front end (apex) of projecting electrode portion 22 in a plan view while preventing damage to the die, it is preferable that the angle of the front end (apex) of projecting electrode portion 22 in a plan view be equal to or larger than 60 degrees. In other words, it is preferable that the apex angle of the above triangular shape be equal to or larger than 60 degrees. It is more preferable that the apex angle of the above triangular shape be 90 degrees. Further, it is preferable that the above triangular shape be an isosceles triangle.

In this case, when a length of a base of the above triangular shape is denoted as W1 and a length of a perpendicular line extending from an apex, which is opposite to the base, to the base is denoted as W2, the length W1 is larger than the length W2. It is preferable, as shown in FIG. 5A, that the length W2 of the perpendicular line of the above triangular shape be equal to or smaller than half of radius r1 of opening 23. If projecting electrode portion 22 is of the triangular shape described above, an electric field can be concentrated on the front end (apex) of projecting electrode portion 22 in a plan view as damage to the die is prevented. This offers an advantage that discharge between discharge portion 11 and projecting electrode portion 22 becomes stable. For example, the length W1 of the base is equal to or smaller than 1 mm.

When the front end (apex) of projecting electrode portion 22 in a plan view is pointed, concentration of an electric filed on this pointed front end readily causes electrocorrosion of the front end, which raises a possibility of time-dependent changes in a discharge state. To prevent time-dependent changes in the discharge state, therefore, it is preferable that the front end (apex) of projecting electrode portion 22 in a plan view include a curved surface. According to this exemplary embodiment, the front end (apex) of projecting electrode portion 22 in a plan view includes a curved surface, as shown in FIG. 5A. According to this exemplary embodiment, for example, a radius of curvature of the front end (apex) of projecting electrode portion 22 in a plan view is about 0.1 mm. In this configuration, compared with a configuration in which the front end (apex) of projecting electrode portion 22 in a plan view is pointed, development of electrocorrosion can be suppressed. As a result, time-dependent change in the discharge state hardly occurs.

(Two) projecting electrode portions 22 have the same shape. In other words, projecting electrode portions 22 are shaped such that projecting electrode portions 22 are 180-degree rotation symmetric with each other with respect to axis P1 of discharge electrode 1. Because of this configuration, at projecting electrode portions 22, a distance from discharge portion 11, which is on axis P1 of discharge electrode 1, to one projecting electrode portion 22 and a distance from discharge portion 11 to another projecting electrode portion 22 are substantially equal to each other.

According to this exemplary embodiment, in the direction along axis P1 of discharge electrode 1 (Z-axis direction), at least a part of peripheral electrode portion 21 is located between discharge portion 11 and projecting electrode portions 22. Specifically, according to this exemplary embodiment, peripheral electrode portion 21, as described above, is formed into the domed shape that projects toward the side separated apart from discharge electrode 1 (positive side of the Z-axis) in the direction along axis P1 of discharge electrode 1 (Z-axis direction). Projecting electrode portion 22 projects from the inner peripheral edge of peripheral electrode portion 21 of the domed shape, i.e., the periphery of opening 23, toward the center of opening 23. As a result, in a view from projecting electrode portion 22, at least a part of peripheral electrode portion 21 is located closer to discharge portion 11, as shown in FIG. 5B. In the direction along axis P1 of discharge electrode 1, i.e., Z-axis direction, therefore, projecting electrode portion 22 is separated further apart from discharge portion 11 than peripheral electrode portion 21 is.

As shown in FIGS. 5B and 5C, peripheral electrode portion 21 includes first edge 211, which is a corner of peripheral electrode portion 21 that is located closest to discharge portion 11. Projecting electrode portion 22, on the other hand, includes a second edge 221, which is a corner of projecting electrode portion 22 that is located closest to discharge portion 11.

According to this exemplary embodiment, first edge 211 is an edge of inner surface 212 of peripheral electrode portion 21 of the domed shape, the edge being closer to discharge electrode 1 in the Z-axis direction. In other words, first edge 211 is a corner of peripheral electrode portion 21 that lies between a surface (inner surface 212) facing axis P1 of discharge electrode 1 and a surface facing the negative side of the Z-axis. First edge 211 is formed along the whole circumference of peripheral electrode portion 21. First edge 211 is, therefore, a circle around axis P1 of discharge electrode 1. As a result, a distance from discharge portion 11, which is on axis P1 of discharge electrode 1, to first edge 211 is substantially the same at any point on the whole circumference of first edge 211.

According to this exemplary embodiment, in a plan view, second edge 221 is an edge of the front end (apex) of projecting electrode portion 22 of the triangular shape, the edge being closer to discharge electrode 1 in the Z-axis direction. In other words, second edge 221 is a corner of projecting electrode portion 22 that lies between a surface facing axis P1 of discharge electrode 1 and a surface facing the negative side of the Z-axis. At (two) projecting electrode portions 22, a distance from discharge portion 11, which is on axis P1 of discharge electrode 1, to second edge 221 of one projecting electrode portion 22 and a distance from discharge portion 11 to second edge 221 of another projecting electrode portion 22 are substantially equal to each other.

Distance D1 from peripheral electrode portion 21 to discharge portion 11 is shorter than distance D2 from projecting electrode portion 22 to discharge portion 11 (D1<D2), as shown in FIGS. 1A and 1B.

"Distance D1" stated in the present disclosure means a shortest distance from peripheral electrode portion 21 to discharge portion 11. In this exemplary embodiment, "distance D1" means a length of a line connecting a point on first edge 211 of peripheral electrode portion 21 to a point on discharge portion 11. "Distance D2" stated in the present disclosure means a shortest distance from projecting electrode portion 22 to discharge portion 11. In this exemplary embodiment, "distance D2" means a length of a line connecting a point on second edge 221 of projecting electrode portion 22 to a point on discharge portion 11.

As described above, according to this exemplary embodiment, discharge electrode 1 holds liquid 50 in such a way as to cover discharge portion 11 with liquid 50, and liquid 50 expands and contracts along axis P1 of discharge electrode 1, i.e., Z-axis direction because of discharge. When liquid 50 is in a state of being expanded along axis P1 of discharge electrode 1, liquid 50 takes the Tailor cone shape, i.e., the first shape, as shown in FIG. 6A. When liquid 50 is in a contracted state, liquid 50 takes the shape formed by collapsing the front end of the Tailor cone, that is, the second shape, as shown in FIG. 6B.

When liquid 50 is in the expanded state (first shape), as shown in FIG. 6A, the distance from peripheral electrode portion 21 to discharge electrode 1 and the distance from projecting electrode portion 22 to discharge electrode 1 should preferably be redefined in the following manner in which liquid 50 is taken as a reference point in place of discharge portion 11. Specifically, as shown in FIG. 6A, when liquid 50 is in the expanded state, distance D3 from liquid 50 to peripheral electrode portion 21 is longer than distance D4 from liquid 50 to projecting electrode portion 22 (D3>D4).

"Distance D3" stated in the present disclosure means a shortest distance from liquid 50 in the expanded state to peripheral electrode portion 21. In this exemplary embodiment, "distance D3" means a length of a line connecting a point on first edge 211 of peripheral electrode portion 21 to the apex of liquid 50 of the first shape (Tailor cone). "Distance D4" stated in the present disclosure means a shortest distance from liquid 50 in the expanded state to projecting electrode portion 22. In this exemplary embodiment, "distance D4" means a length of a line connecting a point on second edge 221 of projecting electrode portion 22 to the apex of liquid 50 of the first shape (Tailor cone).

When liquid 50 is in the contracted state (second shape), as shown in FIG. 6B, the distance from the peripheral electrode portion 21 to discharge electrode 1 and the distance from the projecting electrode portion 22 to discharge electrode 1 should preferably be redefined in the following manner in which liquid 50 is taken as a reference point in place of discharge portion 11. Specifically, as shown in FIG. 6B, when liquid 50 is in the contracted state, distance D5 from liquid 50 to peripheral electrode portion 21 is shorter than distance D6 from liquid 50 to projecting electrode portion 22 (D5<D6).

"Distance D5" stated in the present disclosure means a shortest distance from liquid 50 in the contracted state to peripheral electrode portion 21. In this exemplary embodiment, "distance D5" means a length of a line connecting a point on first edge 211 of peripheral electrode portion 21 to the apex of liquid 50 of the second shape (shape formed by collapsing the front end of the Tailor cone). "Distance D6" stated in the present disclosure means a shortest distance from liquid 50 in the contracted state to projecting electrode portion 22. In this exemplary embodiment, "distance D6" means a length of a line connecting a point on second edge 221 of projecting electrode portion 22 to the apex of liquid 50 of the second shape (shape formed by collapsing the front end of the Tailor cone).

Electrode device 3 according to this exemplary embodiment, which has the relationship between distances D1 to D6 as described above, offers the following advantages. Because distance D1 from peripheral electrode portion 21 to discharge portion 11 is shorter than distance D2 from projecting electrode portion 22 to discharge portion 11, when a voltage is applied across discharge electrode 1 and counter electrode 2, an electric field generated between peripheral electrode portion 21 and discharge portion 11 becomes dominant first. This results in development of discharge in a state in which an extent of electric field concentration is relatively low. In this case, corona discharge is apt to occur. Glow discharge or arc discharge that involves continuous dielectric breakdown, therefore, hardly occurs, which means that a case of a drop in the efficiency in generation of effective components (acidic components, air ions, radicals, and a charged particle liquid containing such components) due to glow discharge or arc discharge hardly occurs.

When liquid 50 held by discharge electrode 1 is subjected to a force exerted by the electric field and forms the Tailor cone, distance D3 from liquid 50 in the expanded state to peripheral electrode portion 21 at this point of time becomes longer than distance D4 from liquid 50 to projecting electrode portion 22. As a result, the electric field tends to concentrate between the front end (apex) of the Tailor cone and projecting electrode portion 22. Thus, discharge carrying relatively high energy occurs between liquid 50 and projecting electrode portion 22. This causes corona discharge having occurred at liquid 50 held by discharge electrode 1 to grow into discharge carrying higher energy. As a result, between discharge electrode 1 and counter electrode 2, discharge path L1 at least partially in a state of dielectric breakdown is formed.

When the force acting on liquid 50 under the influence of the electric field becomes weaker, liquid 50 becomes the contracted state, at which distance D5 from liquid 50 to peripheral electrode portion 21 is shorter than distance D6 from liquid 50 to projecting electrode portion 22. As a result, the electric field then tends to concentrate between liquid 50 and peripheral electrode portion 21. Thus, discharge carrying relatively low energy occurs between liquid 50 and peripheral electrode portion 21, which causes discharge path L1 between discharge electrode 1 and counter electrode 2 to disappear. In this manner, between discharge electrode 1 and counter electrode 2, discharge path L1 at least partially in a state of dielectric breakdown can be formed intermittently.

Figure 7:
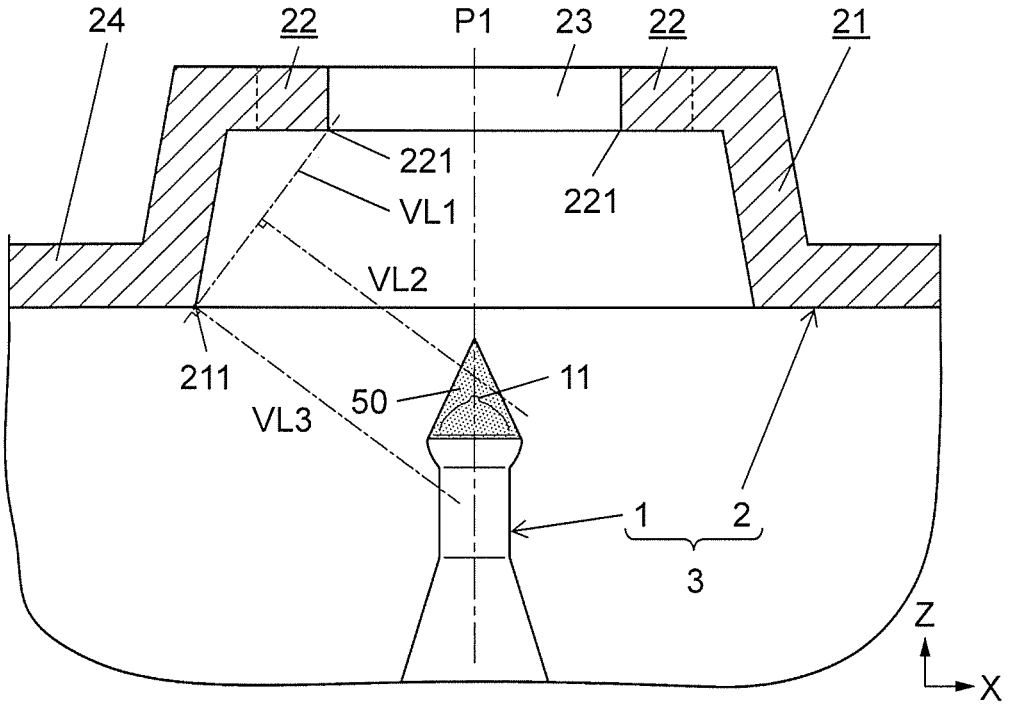
FIG. 7 is a sectional view diagrammatically showing the principle part of the electrode device of the discharge apparatus according to the first exemplary embodiment.

The shape of electrode device 3 according to this exemplary embodiment will hereinafter be described geometrically with reference to FIG. 7. The principle parts of discharge electrode 1 and counter electrode 2 that make up electrode device 3 are depicted diagrammatically in FIG. 7, from which constituent elements other than discharge electrode 1 and counter electrode 2 are omitted when necessary. FIG. 7 is a sectional view taken along virtual plane VP1 (not depicted) including axis P1 of discharge electrode 1 and the front end of projecting electrode portion 22. Virtual plane VP1, virtual line VL1, virtual reference line VL2, and virtual parallel line VL3 in FIG. 7 are virtual plane and lines expressed for better description and do not represent plane and lines as real entity.

As shown in FIG. 7, electrode device 3 according to this exemplary embodiment includes discharge electrode 1 and counter electrode 2. Discharge electrode 1 is the columnar electrode having discharge portion 11 on its front end. Counter electrode 2 faces discharge portion 11. Electrode device 3 discharges when a voltage is applied across discharge electrode 1 and counter electrode 2. Counter electrode 2 has peripheral electrode portion 21 and projecting electrode portion 22. Peripheral electrode portion 21 is disposed to surround axis P1 of discharge electrode 1. Projecting electrode portion 22 projects from the part in the circumferential direction of peripheral electrode portion 21 toward axis P1 of discharge electrode 1. Virtual line VL1 is a virtual line (straight line) that, on virtual plane VP1 (not depicted), connects first edge 211 of peripheral electrode portion 21, first edge 211 being the part of peripheral electrode portion 21 that has the shortest distance to discharge portion 11, to second edge 221 of projecting electrode portion 22, second edge 221 being the part of projecting electrode portion 22 that has the shortest distance to discharge portion 11. When virtual reference line VL2, which is a perpendicular bisector of virtual line VL1, is defined on virtual plane VP1 (not depicted), discharge portion 11 lies on a side on which first edge 211 lies, in a view from virtual reference line VL2. In a view from virtual reference line VL2, specifically, both discharge portion 11 and first edge 211 are located opposite to second edge 221, that is, located on the negative side of the Z-axis. Since virtual reference line VL2 is a perpendicular bisector of virtual line VL1, virtual reference line VL2 is a set of points each having equal distances to both first edge 211 and second edge 221. It follows from this definition that discharge portion 11 is located closer to first edge 211 than to second edge 221. By adopting such an arrangement, distance D1 from peripheral electrode portion 21 to discharge portion 11 (see FIG. 1B) is made shorter than distance D2 from projecting electrode portion 22 to discharge portion 11 (see FIG. 1B) (D1<D2).

According to this exemplary embodiment, on virtual plane VP1, discharge portion 11 is located between virtual reference line VL2 and virtual parallel line VL3. Virtual parallel line VL3 is a virtual line (straight line) that passes first edge 211 and that is parallel with virtual reference line VL2.

According to this exemplary embodiment, when liquid 50 held by discharge electrode 1 is in the expanded state, i.e., first shape, the apex of liquid 50 lies on a side on which second edge 221 lies, in a view from virtual reference line VL2 on virtual plane VP1.

By adopting such an arrangement, distance D3 from liquid 50 in the expanded state to peripheral electrode portion 21 (see FIG. 6A) is made longer than distance D4 from liquid 50 to projecting electrode portion 22 (see FIG. 6A) (D3>D4).

(2.4) Forms of Discharge

Figure 8A:
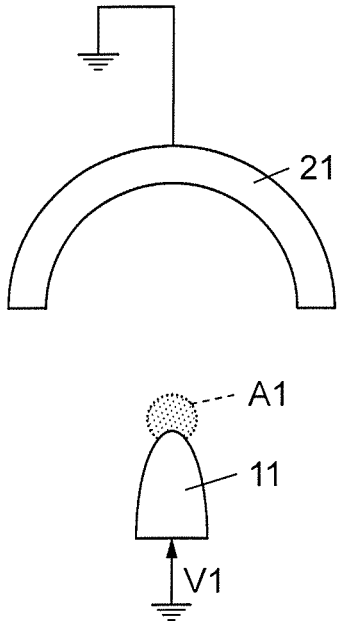
FIG. 8A is a diagrammatical view showing a discharge form of corona discharge.
Figure 8B:
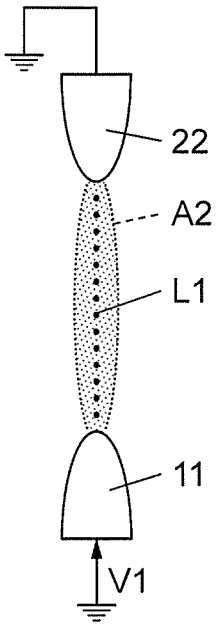
FIG. 8B is a diagrammatical view showing a discharge form of full-scale dielectric breakdown discharge.
Figure 8C:
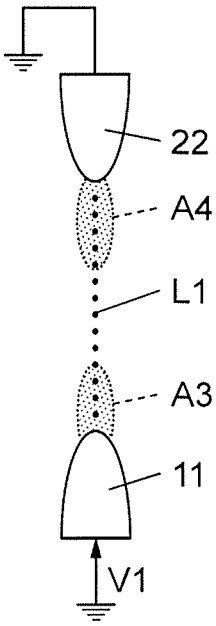
FIG. 8C is a diagrammatical view showing a discharge form of partial dielectric breakdown discharge.

Details of forms of discharge that occur when voltage V1 is applied across discharge electrode 1 and counter electrode 2 will hereinafter be described with reference to FIGS. 8A to 8C. FIGS. 8A to 8C are conceptual diagrams for explaining the forms of discharge, each diagrammatically showing discharge electrode 1 and counter electrode 2. In discharge apparatus 10 according to this exemplary embodiment, actually, liquid 50 is held by discharge electrode 1 and discharge occurs between this liquid 50 and counter electrode 2. However, liquid 50 is omitted from FIGS. 8A to 8C. The following description will be made of an assumed case where discharge portion 11 holds no liquid 50. For a case where discharge portion 11 holds liquid 50, "discharge portion 11 of discharge electrode 1", which refers to a spot at which discharge occurs, should be interpreted as "liquid 50 held by discharge electrode 1".

Now corona discharge will first be described with reference to FIG. 8A.

In general, when energy is applied across a pair of electrodes to cause discharge therebetween, discharge grows to change its form from corona discharge to glow discharge or arc discharge, depending on an amount of energy applied.

Glow discharge as well as arc discharge is a form of discharge that involves dielectric breakdown between the pair of electrodes. In glow discharge and arc discharge, a discharge path formed as a result of dielectric breakdown is maintained during a period in which energy is applied across the pair of electrodes, and therefore a discharge current is kept generated between the pair of electrodes in the period. Corona discharge, on the other hand, is discharge that occurs locally at one electrode (discharge electrode 1 having discharge portion 11) as shown in FIG. 8A. It is discharge that does not involve dielectric breakdown between a pair of electrodes (discharge electrode 1 and counter electrode 2 having peripheral electrode portion 21). In short, applying voltage V1 across discharge electrode 1 and counter electrode 2 causes local corona discharge at discharge portion 11 of discharge electrode 1. In this case, because discharge electrode 1 is on the negative (ground) side, corona discharge developing at discharge portion 11 of discharge electrode 1 is negative corona discharge. At this t e area A1 partially in a state of dielectric breakdown may be created around discharge portion 11 of discharge electrode 1. This area A1 is different in shape from first dielectric breakdown area A3 and second dielectric breakdown area A4 that are created in partial dielectric breakdown discharge, which will be described later. While first dielectric breakdown area A3 and second dielectric breakdown area A4 are each elongated in a specific direction, area A1 is point-like (or spherical).

If a volume of current that can be supplied from a power supply (voltage applying circuit 4) to the pair of electrodes per unit time is sufficiently large, a discharge path having been formed is maintained without interruption, in which case, as described above, corona discharge grows into glow discharge or arc discharge.

Full-scale dielectric breakdown discharge will then be described with reference to FIG. 8B.

Full-scale dielectric breakdown discharge, as shown in FIG. 8B, is a discharge form in which a cycle of development of corona discharge of FIG. 8A into discharge that involves full-scale dielectric breakdown in a discharge path between the pair of electrodes (discharge electrode 1 and counter electrode 2) is repeated intermittently. In this manner, in full-scale dielectric breakdown discharge, discharge path L1 in a state of full-scale dielectric breakdown is created between discharge electrode 1 having discharge portion 11 and counter electrode 2 having projecting electrode portions 22. In this case, between discharge electrode 1 and counter electrode 2, discharge path L1 is in a state of dielectric breakdown as a whole. At this time, between discharge portion 11 of discharge electrode 1 and second edge 221 of one of projecting electrode portions 22 of counter electrode 2, area A2 in a state of dielectric breakdown as a whole may be created. This area A2 is not created as a partial area similar to first dielectric breakdown area A3 and second dielectric breakdown area A4 that are created in partial dielectric breakdown discharge, which will be described late, but is created as an area that connects discharge portion 11 of discharge electrode 1 to projecting electrode portion 22 of counter electrode 2.

"Dielectric breakdown" stated in the present disclosure means that electrical insulation of an insulating material (including a gas), which is interposed between conductors to electrically insulate one conductor from another, is broken to render the insulating material incapable of maintaining an insulated state. Dielectric breakdown of a gas occurs, for example, in a case where ionized molecules are accelerated by an electric field and collide against other gas molecules to ionize them, which increases ion concentration, thus leading to gas discharge.

Full-scale dielectric breakdown discharge is a form of discharge that involves not continuous but intermittent dielectric breakdown between a pair of electrodes (discharge electrode 1 and counter electrode 2). In full-scale dielectric breakdown discharge, therefore, a discharge current is generated also intermittently between the pair of electrodes (discharge electrode 1 and counter electrode 2). As described above, in a case where the power supply (voltage applying circuit 4) does not have a capacity for supplying a volume of current needed to maintain discharge path L1, the voltage applied across the pair of electrodes drops at the moment corona discharge grows into discharge that involves full-scale dielectric breakdown, thus causing discharge path L1 to disappear and discharge to stop. "Volume of current" mentioned here is a volume of current that can be supplied per unit time. Discharge of such a form occurs and stops repeatedly, which causes the discharge current to flow intermittently. In this manner, full-scale dielectric breakdown discharge repeats a high discharge energy state and a low discharge energy state. In this respect, full-scale dielectric breakdown discharge is different from glow discharge and arc discharge that involve continuous dielectric breakdown, that is, generate the discharge current continuously.

Partial dielectric breakdown discharge will then be described with reference to FIG. 8C.

In partial dielectric breakdown discharge, discharge apparatus 10 first causes discharge portion 11 of discharge electrode 1 to generate local corona discharge. In this case, because discharge electrode 1 is on the positive side, corona discharge developing at discharge portion 11 of discharge electrode 1 is positive corona discharge. Discharge apparatus 10 causes corona discharge generated at discharge portion 11 of discharge electrode 1 to grow into discharge carrying higher energy. In this discharge carrying higher energy, discharge path L1 at least partially in a state of dielectric breakdown is formed between discharge electrode 1 and counter electrode 2.

Partial dielectric breakdown discharge is a form of discharge that involves not continuous but intermittent dielectric breakdown partially between a pair of electrodes (discharge electrode 1 and counter electrode 2). In partial dielectric breakdown discharge, therefore, a discharge current is generated also intermittently between the pair of electrodes (discharge electrode 1 and counter electrode 2). Specifically, in a case where the power supply (voltage applying circuit 4) does not have a capacity for supplying a volume of current needed to maintain discharge path L1, the voltage applied across the pair of electrodes drops at the moment corona discharge grows into discharge that involves partial dielectric breakdown, thus causing discharge path L1 to disappear and discharge to stop. Discharge of such a form occurs and stops repeatedly, which causes the discharge current to flow intermittently. In this manner, partial dielectric breakdown discharge repeats a high discharge energy state and a low discharge energy state. In this respect, partial dielectric breakdown discharge is different from glow discharge and arc discharge that involve continuous dielectric breakdown, that is, generate the discharge current continuously.

More specifically, discharge apparatus 10 applies voltage V1 across discharge electrode 1 and counter electrode 2, which are disposed so as to face each other across a gap, thereby causing discharge to develop between discharge electrode 1 and counter electrode 2. At the development of discharge, discharge path L1 at least partially in a state of dielectric breakdown is formed between discharge electrode 1 and counter electrode 2. Discharge path L1 formed in this process includes first dielectric breakdown area A3, which is created around discharge electrode 1 having discharge portion 11, and second dielectric breakdown area A4, which is created around counter electrode 2 having projecting electrode portion 22, as shown in FIG. 8C.

In this manner, between discharge electrode 1 and counter electrode 2, discharge path L1 not fully but partially (locally) in a state of dielectric breakdown is formed. Thus, in partial dielectric breakdown discharge, discharge path L1 formed between discharge electrode 1 and counter electrode 2 is a path that is not fully in a state of dielectric breakdown but is partially in a state of dielectric breakdown.

In partial dielectric breakdown, first dielectric breakdown area A3 and second dielectric breakdown area A4 are separated from each other so that they do not come in contact with each other. In other words, discharge path L1 includes an area (insulation area) not in a state of dielectric breakdown that is present at least between first dielectric breakdown area A3 and second dielectric breakdown area A4. Thus, in partial dielectric breakdown discharge, a space between discharge electrode 1 and counter electrode 2 is not fully in a state of dielectric breakdown but is partially in a state of dielectric breakdown and, in this space, a discharge current flows through discharge path L1. In short, discharge path L1 in which dielectric breakdown occurs partially, that is, discharge path L1 part of which is not in a state of dielectric breakdown allows the discharge current to flow therethrough. Between discharge electrode 1 and counter electrode 2, therefore, the discharge current flows through such discharge path L1 to cause discharge.

Basically, second dielectric breakdown area A4 is created around a part of counter electrode 2 that has a shortest distance (air clearance) to discharge portion H. According to this exemplary embodiment, at counter electrode 2, distance D2 (see FIG. 1B) from second edge 221 of projecting electrode portion 22 to discharge portion 11 is the shortest distance to discharge portion 11. Second dielectric breakdown area A4 is, therefore, created around second edge 221. To put it another way, projecting electrode portion 22 shown in FIG. 8C is actually equivalent to second edge 221.

In full-scale dielectric breakdown discharge (see FIG. 8B) or partial dielectric breakdown discharge (see FIG. 8C), radicals are generated at energy larger than energy in corona discharge (see FIG. 8A). As a result, a large number of radicals about 2 to 10 times the number of radicals generated in corona discharge are generated in full-scale dielectric breakdown discharge or partial dielectric breakdown. Radicals generated in this manner are useful in sterilizing, deodorizing, moisture retention, keeping freshness, and inactivating virus and are used also as radicals that offer advantageous effects in various applications. When radicals are generated by full-scale dielectric breakdown discharge or partial dielectric breakdown discharge, ozone is generated also. However, in full-scale dielectric breakdown discharge or partial dielectric breakdown discharge, ozone is generated in a small amount that is almost equal to an amount of ozone generated by corona discharge, although radicals 2 to 10 times in number radicals generated by corona discharge are generated.

In the case of partial dielectric breakdown discharge (see FIG. 8C), compared with the case of full-scale dielectric breakdown discharge (see FIG. 8B), consumption of radicals by excessively large energy is suppressed, and therefore efficiency in generation of radicals is improved to be higher than efficiency in generation of radicals in full-scale dielectric breakdown discharge. Specifically, in full-scale dielectric breakdown discharge, excessively high energy involved in discharge causes some of generated radicals to disappear, raising a possibility that the efficiency in generation of effective components may drop. In partial dielectric breakdown discharge, in contrast, energy involved in discharge is kept low, compared with the case of full-scale dielectric breakdown discharge. This reduces the number of radicals that disappear when exposed to excessively large energy, thus improving the efficiency in generation of radicals.

In partial dielectric breakdown discharge, compared with the case of full-scale dielectric breakdown discharge, electric filed concentration is less intensive. In full-scale dielectric breakdown discharge, a large discharge current flows instantaneously through the discharge path fully in a state of dielectric breakdown between discharge electrode 1 and counter electrode 2. At this time, electric resistance of the discharge path is extremely low. In partial dielectric breakdown discharge, in contrast, because of less intensive electric field concentration, a maximum value of a current that flows instantaneously through discharge path L1 partially in a state of dielectric breakdown, discharge path L1 being formed between discharge electrode 1 and counter electrode 2, is kept small, compared with the case of full-scale dielectric breakdown discharge. As a result, in partial dielectric breakdown discharge, generation of nitrogen oxides (NOx) is suppressed and electric noise is kept small as well, compared with the case of full-scale dielectric breakdown discharge.

According to this exemplary embodiment, as described above, counter electrode 2 has a plurality of (two) projecting electrode portions 22, and distance D2 (see FIG. 1B) from one projecting electrode portion 22 to discharge electrode 1 and distance D2 from another projecting electrode portion 22 to discharge electrode 1 are equal to each other. Area A2 in a state of dielectric breakdown or second dielectric breakdown area A4 is, therefore, created around second edge 221 of one of projecting electrode portions 22. Projecting electrode portion 22 around which area A2 in a state of dielectric breakdown or second dielectric breakdown area A4 is formed is not limited to specific projecting electrode portion 22, but is randomly selected as one of projecting electrode portions 22.

(3) Modifications

The first exemplary embodiment is one of exemplary embodiments of the present disclosure, and may be modified into various forms of applications according to design requirements or the like. Drawings referred to in the present disclosure are all diagrammatical diagrams/views, in which size ratios and thickness ratios of constituent elements do not always represent actual dimensional ratios. Modifications of the first exemplary embodiment will hereinafter be enumerated. Modifications described below can be applied in their proper combinations.

FIGS. 9A to 9D are diagrammatical sectional views of electrode devices 3*a* to 3*d* according to a modification of the first exemplary embodiment.

Figure 9A:
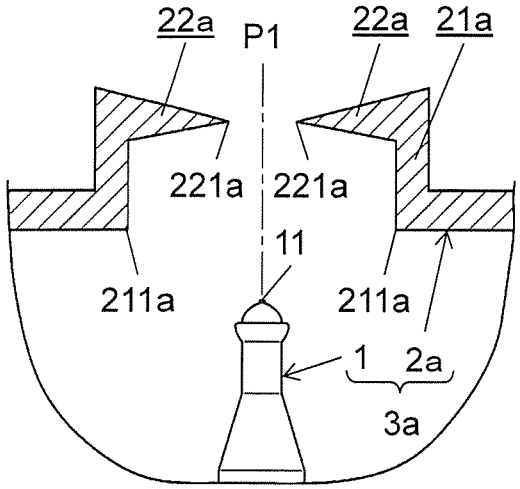
FIG. 9A is a diagrammatical sectional view of an electrode device in a modification of the discharge apparatus according to the first exemplary embodiment.

In electrode device 3*a* shown in FIG. 9A, each of projecting electrode portions 22*a* of counter electrode 2*a* has a section of a tapered shape, which is different from a section of projecting electrode portion 22 of the first exemplary embodiment. This projecting electrode portion 22*a* is of a triangular shape with its apex facing axis P1 of discharge electrode 1. A front end of projecting electrode portion 22*a* thus has a pointed (acute-angle) shape.

Figure 9B:
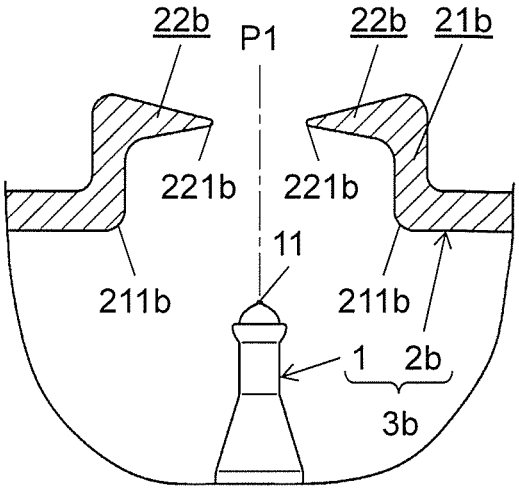
FIG. 9B is a diagrammatical sectional view of an electrode device in a modification of the discharge apparatus according to the first exemplary embodiment.

Electrode device 3*b* shown in FIG. 9B is different from electrode device 3*a* in that corners of counter electrode 2*b* are formed into rounded surfaces (curved surfaces). In the example shown in FIG. 9B, first edge 211*b* and second edge 221*b* are different from first edge 211*a* and second edge 221*a* of electrode device 3*a* shown in FIG. 9A in that first edge 211*b* and second edge 221*b* include rounded surfaces (curved surfaces), respectively.

Figure 9C:
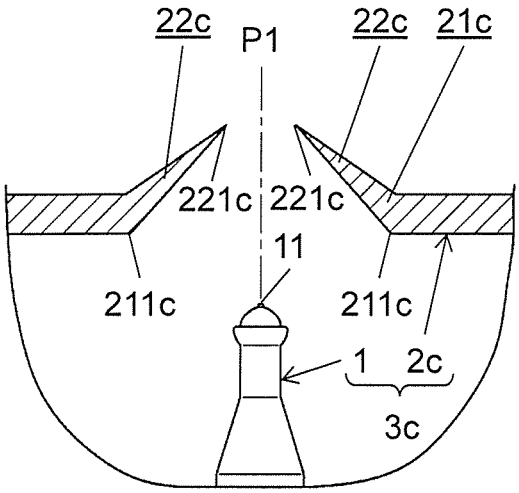
FIG. 9C is a diagrammatical sectional view of an electrode device in a modification of the discharge apparatus according to the first exemplary embodiment.

In electrode device 3*c* shown in FIG. 9C, counter electrode 2*c* has peripheral electrode portion 21*c* of a tabular shape, and a plurality of (two) projecting electrode portions 22*c* projecting slantly from peripheral electrode portion 21*c*. Peripheral electrode portion 21*c* of counter electrode 2*c* is formed into a circular (ring) shape in a plan view. Each projecting electrode portion 22*c* projects slantly toward the positive side of the Z-axis such that as projecting electrode portion 22*c* approaches axis P1 of discharge electrode 1, projecting electrode portion 22*c* moves away from discharge portion 11 in the direction (Z-axis direction) along axis P1 of discharge electrode 1.

Figure 9D:
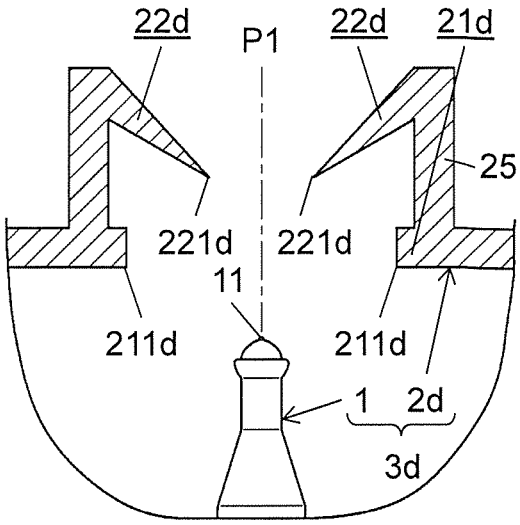
FIG. 9D is a diagrammatical sectional view of an electrode device in a modification of the discharge apparatus according to the first exemplary embodiment.

In electrode device 3*d* shown in FIG. 9D, counter electrode 2*d* has peripheral electrode portion 21*d* of a tabular shape, a plurality of (two) projecting electrode portions 22*d*, and connecting portion 25 connecting peripheral electrode portion 21*d* to projecting electrode portions 22*d*. Peripheral electrode portion 21*d* of counter electrode 2*d* is formed into a circular (ring) shape in a plan view. Connecting portion 25 is formed into a cylindrical shape whose center is axis P1 of discharge electrode 1. Connecting portion 25 has an end closer to discharge portion 11 in the direction (Z-axis direction) along axis P1 of discharge electrode 1, the end being connected to peripheral electrode portion 21*d*, and the other end located opposite to discharge portion 11, the other end being connected to projecting electrode portions 22*d*. In the example of FIG. 9D, each projecting electrode portion 22*d* projects slantly toward the negative side of the Z-axis such that as projecting electrode portion 22*d* approaches axis P1 of discharge electrode 1, projecting electrode portion 22*d* moves closer to discharge portion 11 in the direction (Z-axis direction) along axis P1 of discharge electrode 1.

FIGS. 10A to 10D are diagrammatical plan views of counter electrodes 2*e* to 2*h* according to another modification of the first exemplary embodiment.

Figure 10A:
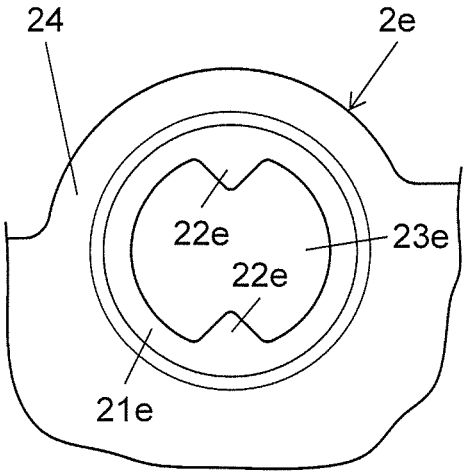
FIG. 10A is a diagrammatical plan view of a counter electrode in another modification of the discharge apparatus according to the first exemplary embodiment.
Figure 10B:
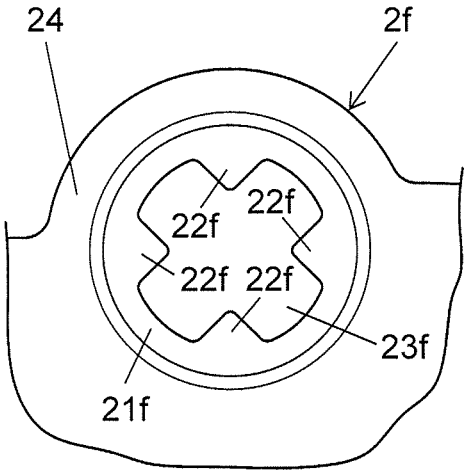
FIG. 10B is a diagrammatical plan view of a counter electrode in another modification of the discharge apparatus according to the first exemplary embodiment.

Counter electrode 2*e* shown in FIG. 10A has a plurality of (two) projecting electrode portions 22*e* lined up in the Y-axis direction. Counter electrode 2*f* shown in FIG. 10B has four projecting electrode portions 22*f*. In FIG. 10B, when the positive side (right side) of the X-axis is defined as "0 degree" and the positive side (upper side) of the Y-axis is defined as "90 degrees", four projecting electrode portions 22*f* are arranged respectively at a 0-degree position, a 90-degree position, a 180-degree position, and a 270-degree position.

Figure 10C:
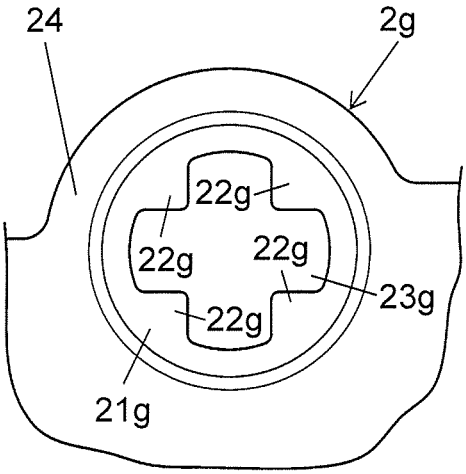
FIG. 10C is a diagrammatical plan view of a counter electrode in another modification of the discharge apparatus according to the first exemplary embodiment.

Counter electrode 2*g* shown in FIG. 10C has four projecting electrode portions 22*g*. In FIG. 10C, when the positive side (right side) of the X-axis is defined as "0 degree" and the positive side (upper side) of the Y-axis is defined as "90 degrees", four projecting electrode portions 22*g* are arranged respectively at a 45-degree position, a 135-degree position, a 225-degree position, and a 315-degree position.

Figure 10D:
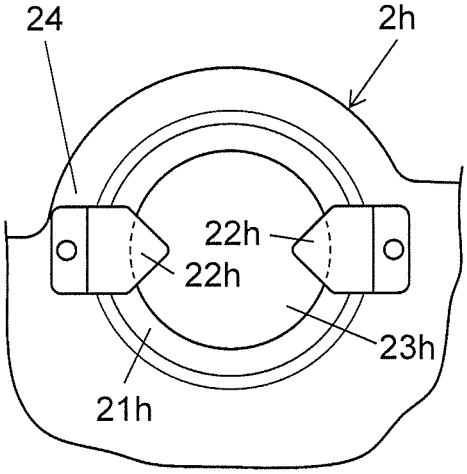
FIG. 10D is a diagrammatical plan view of a counter electrode in another modification of the discharge apparatus according to the first exemplary embodiment.

Counter electrode 2*h* shown in FIG. 10D has peripheral electrode portion 21*h*, and projecting electrode portions 22*h* that are provided as separate components to peripheral electrode portion 21*h*. In this case, similar to the case of projecting electrode portions 22, projecting electrode portions 22*h* each project from a part in the circumferential direction of peripheral electrode portion 21*h* toward, for example, axis P1 of discharge electrode 1 shown in FIG. 1B. In this case, projecting electrode portion 22*h* is fixed to peripheral electrode portion 21*h* by a proper joining method, such as welding, screwing, and caulking.

The shapes of discharge electrode 1 and counter electrode 2 of electrode device 3 are not limited to shapes shown in FIGS. 9A to 10D, but other proper shapes may be adopted as the shapes of discharge electrode 1 and counter electrode 2. For example, in a plan view, a proper shape, such as a circular, elliptical, rectangular, or polygonal shape, may be adopted as the shape of peripheral electrode portion 21 of counter electrode 2 of electrode device 3 shown FIGS. 1A and 1B. An outer diameter, an inner diameter, and a thickness of any given values may be adopted as the outer diameter, the inner diameter, and the thickness of peripheral electrode portion 21. Similarly, in a plan view, a proper shape, such as a needle-like, triangular, rectangular, or polygonal shape, may be adopted as the shape of projecting electrode portion 22 of counter electrode 2. An extent of projection, a width, and a thickness of any given values may be adopted as the extent of projection, the width, and the thickness of projecting electrode portion 22.

Counter electrode 2 may not have 2 or 4 projecting electrode portions 22 but may have a proper number of projecting electrode portions 22. For example, counter electrode 2 may have an odd number of projecting electrode portions 22. The number of projecting electrode portions 22 of counter electrode 2 is not limited to 2 or 4 but may be, for example, 1, 3, 5, or more. Arranging projecting electrode portions 22 at equal intervals along the circumferential direction of opening 23 is not an essential configuration. Projecting electrode portions 22 may be arranged at properly determined intervals along the circumferential direction of opening 23.

Discharge apparatus 10 shown in FIG. 2 may not include liquid supply unit 5 for generating the charged particle liquid. In this case, discharge apparatus 10 generates air ions by discharge (full-scale dielectric breakdown discharge or partial dielectric breakdown discharge) that develops between discharge electrode 1 and counter electrode 2.

The configuration of liquid supply unit 5 is not limited to the configuration described in the first exemplary embodiment in which liquid supply unit 5 cools discharge electrode 1 to cause it to generate dew condensation water. Liquid supply unit 5, for example, may be configured to supply liquid 50 from a tank to discharge electrode 1, using, for example, a capillarity phenomenon or a supply mechanism, such as a pump. Liquid 50 does not always have to be water (including dew condensation water) but may be a liquid different from water.

Voltage applying circuit 4 may be configured such that it applies a high voltage across discharge electrode 1 serving as a negative electrode (ground) and counter electrode 2 serving as a positive electrode (positive node). Further, since creating a potential difference (voltage) between discharge electrode 1 and counter electrode 2 is enough, voltage applying circuit 4 may apply a negative voltage to electrode device 3 in which an electrode with a higher potential (positive electrode) is a ground node and an electrode with a lower potential (negative electrode) is a node with a negative potential. In other words, in its voltage application, voltage applying circuit 4 may determine discharge electrode 1 to be the ground node and counter electrode 2 to be the node with the negative potential, or may determine discharge electrode 1 to be the node with the negative potential and counter electrode 2 to be the ground node.

Limiting resistor R1 may be interposed between voltage generating circuit 41 and discharge electrode 1. In this case, discharge electrode 1 serves as the positive electrode (positive node). Limiting resistor R1 is, therefore, interposed between a high-voltage side output end of voltage generating circuit 41 and electrode device 3. In another case where discharge electrode 1 serves as the negative electrode (ground) and counter electrode 2 serves as the positive electrode (positive node), limiting resistor R1 may be interposed between a low-voltage side output end or high-voltage side output end of voltage generating circuit 41 and electrode device 3.

Functions similar to functions of voltage applying circuit 4 according to the first exemplary embodiment may be achieved by a method for controlling voltage applying circuit 4, a computer program, or a recording medium or the like on which the computer program is recorded. In other words, functions corresponding to functions of control circuit 43 may be achieved by the method for controlling voltage applying circuit 4, the computer program, or the recording medium or the like on which the computer program is recorded.

When "equal to or larger than" is used to express a result of comparison of two values, it means the following two cases: two values are equal; and one value is larger than the other value. However, not limited to the above definition, "equal to or larger than" may also be used as a synonym for "larger than", which means only the case where one value is larger than the other value. Specifically, because whether the case of two values being equal should be included in the above expression can be changed according to the set threshold or the like, "equal to or larger than" and "larger than" create no significant difference in terms of technical expression. For the same reason, "smaller than" may be interpreted as a synonym for "equal to or smaller than".

Second Exemplary Embodiment

Figure 11:
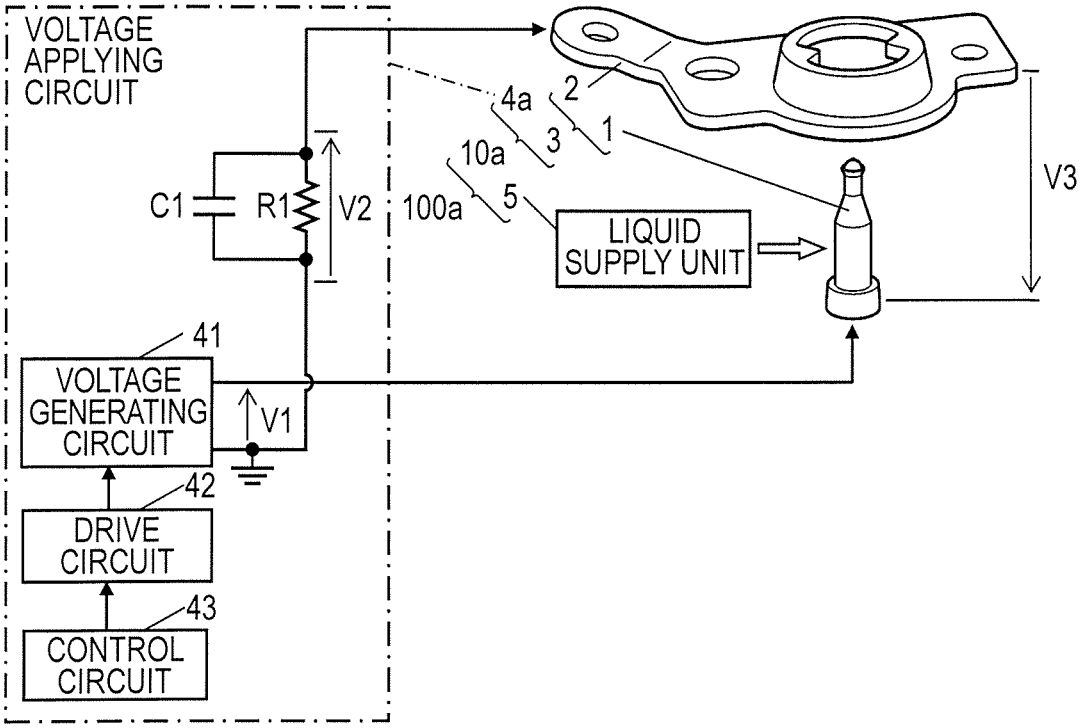
FIG. 11 is a block diagram of an electrostatic atomization system including a discharge apparatus according to a second exemplary embodiment.

As shown in FIG. 11, electrostatic atomization system 100*a* according to a second exemplary embodiment is different from electrostatic atomization system 100 according to the first exemplary embodiment in that voltage applying circuit 4*a* of discharge apparatus 10*a* has a configuration different from the configuration of voltage applying circuit 4 of electrostatic atomization system 100. In the following description, the same constituent elements as described in the first exemplary embodiment will be denoted by the same reference symbols and be omitted in further description when necessary.

According to the second exemplary embodiment, voltage applying circuit 4*a* includes capacitor C1 electrically connected in parallel to limiting resistor R1, as shown in FIG. 11. In other words, capacitor C1, together with limiting resistor R1, is interposed between voltage generating circuit 41 and electrode device 3. Capacitor C1 has a function of inhibiting a voltage drop caused by limiting resistor R1 to keep voltage V3 at a given or higher voltage level, voltage V3 being applied to electrode device 3 (discharge electrode 1 and counter electrode 2).

In a case where capacitor C1 is not present, when voltage generating circuit 41 generates applied voltage V1 to cause discharge (full-scale dielectric breakdown discharge or partial dielectric breakdown discharge), a discharge current flowing through discharge path L1 (see FIGS. 8B and 8C) causes a voltage drop at limiting resistor R1. As a result, voltage V2 is generated across both ends of limiting resistor R1, in which case voltage V3 applied to electrode device 3 (discharge electrode 1 and counter electrode 2) is defined as a voltage given by deducting voltage V2 from applied voltage V1. If the voltage drop at limiting resistor R1 is relatively large, therefore, voltage V3 applied to electrode device 3 (discharge electrode 1 and counter electrode 2) is relatively small.

According to this exemplary embodiment, however, voltage applying circuit 4*a* has capacitor C1 electrically connected in parallel to limiting resistor R1 and this capacitor C1 inhibits the voltage drop from occurring at limiting resistor R1. Specifically, when voltage generating circuit 41 generates applied voltage V1 to cause discharge (full-scale dielectric breakdown discharge or partial dielectric breakdown discharge), the discharge current, which flows through discharge path L1, travels through capacitor C1 at least at an initial stage of flowing. As a result, the discharge current flowing through limiting resistor R1 becomes small, which inhibits the voltage drop at limiting resistor R1. In this manner, discharge apparatus 10*a* according to this exemplary embodiment keeps the voltage drop at limiting resistor R1 relatively small, thus ensuring that voltage V3 applied to electrode device 3 (discharge electrode 1 and counter electrode 2) is relatively large.

Figure 12A:
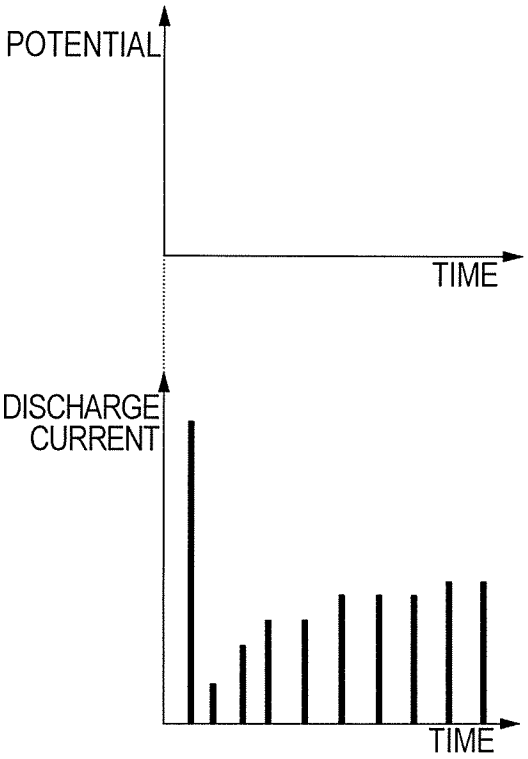
FIG. 12A is an explanatory view for explaining an operation of the discharge apparatus according to the second exemplary embodiment.
Figure 12B:
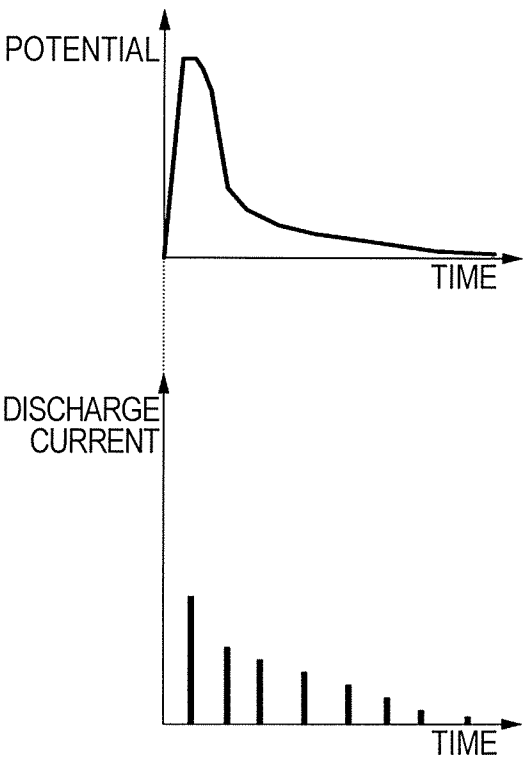
FIG. 12B is an explanatory view for explaining an operation of the discharge apparatus according to the second exemplary embodiment.
Figure 12C:
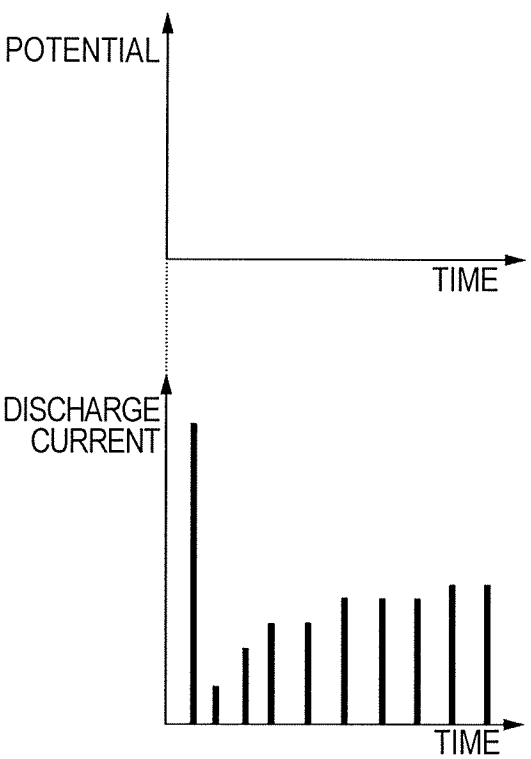
FIG. 12C is an explanatory view for explaining an operation of the discharge apparatus according to the second exemplary embodiment.

FIGS. 12A to 12C are explanatory views for explaining operations of discharge apparatus 10*a* according to this exemplary embodiment. Each of FIGS. 12A to 12C is a diagrammatical view showing two graphs which have respective horizontal axes commonly representing time and vertical axes representing a potential of counter electrode 2 and a discharge current, respectively. In each of FIGS. 12A to 12C, the potential of counter electrode 2 is plotted on the graph on the upper side, while the discharge current is plotted on the graph on the lower side.

FIG. 12A shows the graphs drawn on the assumption that limiting resistor R1 and capacitor C1 are omitted from the configuration shown in FIG. 11, that is, voltage generating circuit 41 is directly connected to electrode device 3. In this assumed configuration, the voltage drop at limiting resistor R1 does not occur. As a result, the potential of counter electrode 2, which serves as a negative electrode (ground), is almost fixed to "0". In this case, voltage V3 substantially equal in magnitude to applied voltage V1 is applied to electrode device 3 (discharge electrode 1 and counter electrode 2). As a result, discharge path L1 at least partially in a state of dielectric breakdown is created intermittently between discharge electrode 1 and counter electrode 2, and therefore a relatively large discharge current flows intermittently, as indicated in FIG. 12A.

FIG. 12B shows the graphs drawn on the assumption that capacitor C1 is omitted from the configuration shown in FIG. 11, that is, voltage generating circuit 41 is connected to electrode device 3 via limiting resistor R1 only (which is equivalent to the configuration according to the first exemplary embodiment). In this assumed configuration, the voltage drop at limiting resistor R1 occurs. As a result, the potential of counter electrode 2, which serves as the negative electrode (ground), rises as a discharge current is generated. In this case, voltage V3 applied to electrode device 3 (discharge electrode 1 and counter electrode 2) becomes smaller than applied voltage V1. This makes it impossible to maintain discharge path L1 between discharge electrode 1 and counter electrode 2, thus, as indicated in FIG. 12B, making it impossible to cause a discharge current of a sufficient magnitude to flow intermittently. Hence, between discharge electrode 1 and counter electrode 2, discharge (full-scale dielectric breakdown discharge or partial dielectric breakdown discharge) that intermittently forms discharge path L1 at least partially in a state of dielectric breakdown hardly occurs.

FIG. 12C shows the graphs drawn on the assumption that voltage generating circuit 41 is connected to electrode device 3 via limiting resistor R1 and capacitor C1 connected in parallel to each other, which is the configuration according to the second exemplary embodiment, i.e., the configuration shown in FIG. 11. In this assumed configuration, the voltage drop at limiting resistor R1 hardly occurs. As a result, the potential of counter electrode 2, which serves as the negative electrode (ground), is almost fixed to "0". In this case, voltage V3 substantially equal in magnitude to applied voltage V1 is applied to electrode device 3 (discharge electrode 1 and counter electrode 2). As a result, discharge path L1 at least partially in a state of dielectric breakdown is created intermittently between discharge electrode 1 and counter electrode 2, and therefore a relatively large discharge current flows intermittently, as indicated in FIG. 12C.

Various configurations (including modifications) described in the second exemplary embodiment can be combined properly with various configurations (including modifications) described in the first exemplary embodiment for use in various applications.

CONCLUSION

As described above, electrode device (3, 3*a* to 3*d*) according to a first aspect of the present disclosure includes: discharge electrode (1) of a columnar shape, discharge electrode (1) having discharge portion (11) on a front end of discharge electrode (1); and counter electrode (2, 2*a* to 2*h*) facing discharge portion (11). Electrode device (3, 3*a* to 3*d*) discharges when a voltage is applied across discharge electrode (1) and counter electrode (2, 2*a* to 2*h*). Counter electrode (2, 2*a* to 2*h*) has peripheral electrode portion (21) and projecting electrode portion (22). Peripheral electrode portion (21) is disposed to surround axis (P1) of discharge electrode (1). Projecting electrode portion (22) projects from a part of peripheral electrode portion (21) toward axis (P1) of discharge electrode (1). Distance (D1) from peripheral electrode portion (21) to discharge portion (11) is shorter than distance (D2) from projecting electrode portion (22) to discharge portion (11).

According to the first aspect, when a voltage is applied across discharge electrode (1) and counter electrode (2, 2*a* to 2*h*), an electric field may concentrate on both peripheral electrode portion (21) and projecting electrode portion (22) of counter electrode (2, 2*a* to 2*h*) facing discharge portion (11). Because projecting electrode portion (22) projects from the part in the circumferential direction of peripheral electrode portion (21) toward axis P1 of discharge electrode (1), a facing area of peripheral electrode portion (21) that faces discharge portion (11) is larger than a facing area of projecting electrode portion (22) that faces discharge portion (11). For this reason, an extent of electric filed concentration at projecting electrode portion (22), which has the facing area smaller than the facing area of peripheral electrode portion (21), the facing areas facing discharge portion (11), is greater than an extent of electric filed concentration at peripheral electrode portion (21). Meanwhile, distance (D1) from peripheral electrode portion (21) to discharge portion (11) is shorter than distance (D2) from projecting electrode portion (22) to discharge portion (11). When the voltage is applied across discharge electrode (1) and counter electrode (2, 2*a* to 2*h*), therefore, an electric field generated between peripheral electrode portion (21) and discharge portion (11) becomes dominant first. This results in development of discharge in a state in which an extent of electric field concentration is relatively low. In this case, corona discharge is apt to occur. Glow discharge or arc discharge that involves continuous dielectric breakdown, therefore, hardly occurs, which means that a case of a drop in efficiency in generation of effective components due to glow discharge or arc discharge hardly occurs.

In electrode device (3, 3*a* to 3*d*) according to a second aspect of the present disclosure, discharge electrode (1) of the first aspect holds liquid (50) in such a way as to cover discharge portion (11) with liquid (50). Liquid (50) expands and contracts along axis (P1) of discharge electrode (1) because of discharge. When liquid (50) is in an expanded state, distance (D3) from liquid (50) to peripheral electrode portion (21) may be longer than distance (D4) from liquid (50) to projecting electrode portion (22).

According to the second aspect, when liquid (50) is in the expanded state, an electric filed tends to concentrate between liquid (50) and projecting electrode portion (22). As a result, discharge that involves dielectric breakdown tends to occur between liquid (50) and counter electrode (2, 2*a* to 2*h*).

In electrode device (3, 3*a* to 3*d*) according to a third aspect of the present disclosure, when liquid (50) of the second aspect is in a contracted state, distance (D5) from liquid (50) to peripheral electrode portion (21) may be shorter than distance (D6) from liquid (50) to projecting electrode portion (22).

According to the third aspect, when liquid (50) is in the contracted state, an electric filed tends to concentrate between liquid (50) and peripheral electrode portion (21). As a result, corona discharge tends to occur.

In electrode device (3, 3*a* to 3*d*) according to a fourth aspect of the present disclosure, peripheral electrode portion (21) of the first aspect has opening (23) of a circular shape. A center of opening (23) may lie on axis (P1) of discharge electrode (1).

According to the fourth aspect, a distance from a part of peripheral electrode portion (21) that extends along a periphery of opening (23) to discharge portion (11) is uniform.

In electrode device (3, 3*a* to 3*d*) according to a fifth aspect of the present disclosure, counter electrode (2, 2*a* to 2*h*) of the first aspect may have a plurality of projecting electrode portions (22).

According to the fifth aspect, discharge occurs dispersively at each of projecting electrode portions (22).

In electrode device (3, 3*a* to 3*d*) according to a sixth aspect of the present disclosure, projecting electrode portions (22) of the fifth aspect may be arranged at equal intervals along a circumferential direction of peripheral electrode portion (21).

According to the sixth aspect, discharge is caused at each of projecting electrode portions (22) in a uniform manner.

In electrode device (3, 3*a* to 3*d*) according to a seventh aspect of the present disclosure, discharge electrode (1) and counter electrode (2, 2*a* to 2*h*) of the first aspect are separated from each other in a direction along axis (P1) of discharge electrode (1). In the direction along axis (P1) of discharge electrode (1), at least a part of peripheral electrode portion (21) may be located between discharge portion (11) and projecting electrode portion (22).

According to the seventh aspect, in the direction along axis (P1) of discharge electrode (1), distance (2) from projecting electrode portion (22) to discharge portion (11) can be made large.

In electrode device (3, 3*a* to 3*d*) according to an eighth aspect of the present disclosure, peripheral electrode portion (21) of the first aspect includes first edge (211) projecting toward discharge portion (11). Projecting electrode portion (22) includes second edge (221) projecting toward discharge portion (11). Distance (D1) from peripheral electrode portion (21) to discharge portion (11) is equivalent to a distance from first edge (211) to discharge portion (11). Distance (D2) from projecting electrode portion (22) to discharge portion (11) may be equivalent to a distance from second edge (221) to discharge portion (11).

According to the eighth aspect, electric field concentration tends to occur at first edge (211) and second edge (221) each projecting toward discharge portion (11).

Electrode device (3, 3*a* to 3*d*) according to a ninth aspect includes: discharge electrode (1) of a columnar shape, discharge electrode (1) having discharge portion (11) on a front end of discharge electrode (1); and counter electrode (2, 2*a* to 2*h*) facing discharge portion (11). Electrode device (3, 3*a* to 3*d*) discharges when a voltage is applied across discharge electrode (1) and counter electrode (2, 2*a* to 2*h*). Counter electrode (2, 2*a* to 2*h*) has peripheral electrode portion (21) and projecting electrode portion (22). Peripheral electrode portion (21) is disposed to surround axis (P1) of discharge electrode (1). Projecting electrode portion (22) projects from a part of peripheral electrode portion (21) toward axis (P1) of discharge electrode (1). When virtual reference line (VL2) is defined on virtual plane (VP1), discharge portion (11) may lie on a side on which first edge (211) lies, in a view from virtual reference line (VL2). Virtual plane (VP1) is a plane including axis (P1) of discharge electrode (1) and a front end of projecting electrode portion (22). Virtual reference line (VL2) is a perpendicular bisector of virtual line (VL1). Virtual line (VL1) is a line that connects first edge (211) to second edge (221). First edge (211) is a part of peripheral electrode portion (21) that has a shortest distance to discharge portion (11), the shortest distance being distance (D1). Second edge (221) is a part of projecting electrode portion (22) that has a shortest distance to discharge portion (11), the shortest distance being distance (D2).

According to the ninth aspect, when a voltage is applied across discharge electrode (1) and counter electrode (2, 2*a* to 2*h*), an electric field may concentrate on both peripheral electrode portion (21) and projecting electrode portion (22) of counter electrode (2, 2*a* to 2*h*) facing discharge portion (11). Because projecting electrode portion (22) projects from the part in the circumferential direction of peripheral electrode portion (21) toward axis (P1) of discharge electrode (1), a facing area of peripheral electrode portion (21) that faces discharge portion (11) is larger than a facing area of projecting electrode portion (22) that faces discharge portion (11). For this reason, an extent of electric filed concentration at projecting electrode portion (22), which has the facing area smaller than the facing area of peripheral electrode portion (21), the facing areas facing discharge portion (11), is greater than an extent of electric filed concentration at peripheral electrode portion (21). Meanwhile, distance (D1) from peripheral electrode portion (21) to discharge portion (11) is shorter than distance (D2) from projecting electrode portion (22) to discharge portion (11). When the voltage is applied across discharge electrode (1) and counter electrode (2, 2*a* to 2*h*), therefore, an electric field generated between peripheral electrode portion (21) and discharge portion (11) becomes dominant first. This results in development of discharge in a state in which an extent of electric field concentration is relatively low. In this case, corona discharge is apt to occur. Glow discharge or arc discharge that involves continuous dielectric breakdown, therefore, hardly occurs, which means that a case of a drop in efficiency in generation of effective components due to glow discharge or arc discharge hardly occurs.

In electrode device (3, 3*a* to 3*d*) according to a tenth aspect, when virtual parallel line (VL3) is defined on virtual plane (VP1) of the ninth aspect, discharge portion (11) is located between virtual reference line (VL2) and virtual parallel line (VL3). Virtual parallel line (VL3) may be a line that passes first edge (211) and that is parallel with virtual reference line (VL2).

According to the tenth aspect, distance (D2) from projecting electrode portion (22) to discharge portion (11) is determined to be relatively short. In this configuration, electric energy needed to cause discharge between projecting electrode portion (22) and discharge portion (11) is kept small.

Discharge apparatus (10, 10*a*) according to an eleventh aspect of the present disclosure may include electrode device (3, 3*a* to 3*d*) of the first aspect and voltage applying circuit (4, 4*a*). Voltage applying circuit (4, 4*a*) applies voltage (V1) across discharge electrode (1) and counter electrode (2, 2*a* to 2*h*) to cause both electrodes to generate discharge.

According to the eleventh aspect, when a voltage is applied across discharge electrode (1) and counter electrode (2, 2*a* to 2*h*), an electric field may concentrate on both peripheral electrode portion (21) and projecting electrode portion (22) of counter electrode (2, 2*a* to 2*h*) facing discharge portion (11). Because projecting electrode portion (22) projects from a part of peripheral electrode portion (21) toward axis (P1) of discharge electrode (1), a facing area of peripheral electrode portion (21) that faces discharge portion (11) is larger than a facing area of projecting electrode portion (22) that faces discharge portion (11). For this reason, an extent of electric filed concentration at projecting electrode portion (22), which has the facing area smaller than the facing area of peripheral electrode portion (21), the facing areas facing discharge portion (11), is greater than an extent of electric filed concentration at peripheral electrode portion (21). Meanwhile, distance (D1) from peripheral electrode portion (21) to discharge portion (11) is shorter than distance (D2) from projecting electrode portion (22) to discharge portion (11). When the voltage is applied across discharge electrode (1) and counter electrode (2, 2*a* to 2*h*), therefore, an electric field generated between peripheral electrode portion (21) and discharge portion (11) becomes dominant first. This results in development of discharge in a state in which an extent of electric field concentration is relatively low. In this case, corona discharge is apt to occur. Glow discharge or arc discharge that involves continuous dielectric breakdown, therefore, hardly occurs, which means that a case of a drop in efficiency in generation of effective components due to glow discharge or arc discharge hardly occurs.

In discharge apparatus (10, 10*a*) according to an twelfth aspect of the present disclosure, voltage applying circuit (4, 4*a*) of the eleventh aspect includes voltage generating circuit (41) and limiting resistor (R1). Voltage generating circuit (41) generates applied voltage (V1). Limiting resistor (R1) may be interposed between one output end of voltage generating circuit (41) and electrode device (3, 3*a* to 3*d*).

According to the twelfth aspect, electrode device (3, 3*a* to 3*d*) and the like can be protected from overcurrent.

In discharge apparatus (10, 10*a*) according to a thirteenth aspect of the present disclosure, limiting resistor (R1) of the twelfth aspect is interposed between a low-voltage-side output end of voltage generating circuit (41) and electrode device (3, 3*a* to 3*d*).

According to the thirteenth aspect, electrode device (3, 3*a* to 3*d*) and the like can be protected from overcurrent.

In discharge apparatus (10, 10*a*) according to a fourteenth aspect of the present disclosure, voltage applying circuit (4, 4*a*) of the twelfth aspect further includes capacitor (C1) electrically connected in parallel to limiting resistor (R1).

According to the fourteenth aspect, a voltage drop at limiting resistor (R1) can be kept relatively small.

Electrostatic atomization system (100, 100*a*) according to a fifteenth aspect of the present disclosure includes: discharge apparatus (10, 10*a*) according to the eleventh aspect; and liquid supply unit (5) that supplies liquid (50) to discharge electrode (1). Electrostatic atomization system (100, 100*a*) may electrostatically atomize liquid (50) by discharge caused by discharge apparatus (10, 10*a*).

According to the fifteenth aspect, when a voltage is applied across discharge electrode (1) and counter electrode (2, 2*a* to 2*h*), an electric field may concentrate on both peripheral electrode portion (21) and projecting electrode portion (22) of counter electrode (2, 2*a* to 2*h*) facing discharge portion (11). Because projecting electrode portion (22) projects from a part of peripheral electrode portion (21) toward axis (P1) of discharge electrode (1), a facing area of peripheral electrode portion (21) that faces discharge portion (11) is larger than a facing area of projecting electrode portion (22) that faces discharge portion (11). For this reason, an extent of electric filed concentration at projecting electrode portion (22), which has the facing area smaller than the facing area of peripheral electrode portion (21), the facing areas facing discharge portion (11), is greater than an extent of electric filed concentration at peripheral electrode portion (21). Meanwhile, distance (D1) from peripheral electrode portion (21) to discharge portion (11) is shorter than distance (D2) from projecting electrode portion (22) to discharge portion (11). When the voltage is applied across discharge electrode (1) and counter electrode (2, 2*a* to 2*h*), therefore, an electric field generated between peripheral electrode portion (21) and discharge portion (11) becomes dominant first. This results in development of discharge in a state in which an extent of electric field concentration is relatively low. In this case, corona discharge is apt to occur. Glow discharge or arc discharge that involves continuous dielectric breakdown, therefore, hardly occurs, which means that a case of a drop in efficiency in generation of effective components due to glow discharge or arc discharge hardly occurs.

The electrode device, the discharge apparatus, and the electrostatic atomization system can be applied to various pieces of equipment and machines, such as refrigerators, washing machines, dryers, air conditioners, electric fans, air cleaners, humidifiers, facial treatment devices, and automobiles.

What is claimed is:

1. An electrode device comprising:

a discharge electrode of a columnar shape, the discharge electrode having a discharge portion on a front end of the discharge electrode; and a counter electrode facing the discharge portion, wherein the electrode device discharges when a voltage is applied across the discharge electrode and the counter electrode, wherein the counter electrode includes:

a peripheral electrode portion having an opening surrounding an axis of the discharge electrode; and a projecting electrode portion projecting from a part of the peripheral electrode portion into the opening in plan view toward the axis of the discharge electrode, wherein a distance from the peripheral electrode portion to the discharge portion is shorter than a distance from a distal end of the projecting electrode portion to the discharge portion, the counter electrode further includes a connection portion connecting the peripheral electrode portion and the projecting electrode portion, and the connection portion has a cylindrical shape extending from the peripheral electrode portion to a direction away from the discharge electrode.

2. The electrode device according to claim 1, wherein the discharge electrode holds a liquid in such a way as to cover the discharge portion with the liquid, wherein the liquid expands and contracts along the axis of the discharge electrode because of discharge, and wherein when the liquid is in an expanded state, a distance from the liquid to the peripheral electrode portion is longer than a distance from the liquid to the projecting electrode portion.

3. The electrode device according to claim 2, wherein when the liquid is in a contracted state, a distance from the liquid to the peripheral electrode portion is shorter than a distance from the liquid to the projecting electrode portion.

4. The electrode device according to claim 1, wherein the opening has a circular shape, and wherein a center of the opening lies on the axis of the discharge electrode.

5. The electrode device according to claim 1, wherein the counter electrode has a plurality of the projecting electrode portions.

6. The electrode device according to claim 5, wherein the plurality of projecting electrode portions are arranged at equal intervals along a circumferential direction of the peripheral electrode portion.

7. The electrode device according to claim 1, wherein the discharge electrode and the counter electrode are separated from each other in a direction along the axis of the discharge electrode, and wherein in the direction along the axis of the discharge electrode, at least a part of the peripheral electrode portion is located between the discharge portion and the projecting electrode portion.

8. The electrode device according to claim 1, wherein the peripheral electrode portion includes a first edge portion projecting toward the discharge portion, wherein the projecting electrode portion includes a second edge portion projecting toward the discharge portion, wherein the distance from the peripheral electrode portion to the discharge portion is equivalent to a distance from the first edge portion to the discharge portion, and wherein the distance from the distal end of the projecting electrode portion to the discharge portion is equivalent to a distance from a distal end of the second edge portion to the discharge portion.

9. An electrode device comprising:

a discharge electrode of a columnar shape, the discharge electrode having a discharge portion on a front end of the discharge electrode; and a counter electrode facing the discharge portion, wherein the electrode device discharges when a voltage is applied across the discharge electrode and the counter electrode, wherein the counter electrode includes:

a peripheral electrode portion having an opening surrounding an axis of the discharge electrode; and a projecting electrode portion projecting from a part of the peripheral electrode portion into the opening in plan view toward the axis of the discharge electrode, wherein, on a virtual plane including the axis of the discharge electrode and a front end of the projecting electrode portion, when a virtual reference line is defined as a perpendicular bisector of a virtual line that connects a first edge of the peripheral electrode portion, the first edge being a part of the peripheral electrode portion that has a shortest distance to the discharge portion, to a second edge of the projecting electrode portion, the second edge being a part of the projecting electrode portion that has a shortest distance to the discharge portion, the discharge portion lies on a side on which the first edge lies, in a view from the virtual reference line, wherein, on the virtual plane, when a virtual parallel line is defined, the virtual parallel line passing the first edge and being parallel with the virtual reference line, and the discharge portion is located between the virtual reference line and the virtual parallel line.

10. A discharge apparatus comprising:

the electrode device according to claim 1; and a voltage applying circuit that applies a voltage across the discharge electrode and the counter electrode to cause the electrode device to discharge.

11. The discharge apparatus according to claim 10, wherein the voltage applying circuit includes:

a voltage generating circuit that generates the voltage to be applied; and a limiting resistor interposed between one output end of the voltage generating circuit and the electrode device.

12. The discharge apparatus according to claim 11, wherein the limiting resistor is interposed between a low-potential-side output end of the voltage generating circuit and the electrode device.

13. The discharge apparatus according to claim 11, wherein the voltage applying circuit further includes a capacitor that is electrically connected in parallel to the limiting resistor.

14. An electrostatic atomization system comprising:

the discharge apparatus according to claim 10; and a liquid supply unit that supplies a liquid to the discharge electrode, wherein the liquid is electrostatically atomized by discharge caused by the discharge apparatus.

* * * * *